US008502842B2

(12) United States Patent
Bae

(10) Patent No.: US 8,502,842 B2
(45) Date of Patent: Aug. 6, 2013

(54) OFFSETTING MULTIPLE COUPLING EFFECTS IN DISPLAY SCREENS

(75) Inventor: Hopil Bae, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 219 days.

(21) Appl. No.: 13/143,189

(22) PCT Filed: May 24, 2011

(86) PCT No.: PCT/US2011/037805

§ 371 (c)(1),
(2), (4) Date: Jul. 1, 2011

(87) PCT Pub. No.: WO2012/161700

PCT Pub. Date: Nov. 29, 2012

(65) Prior Publication Data

US 2012/0299972 A1 Nov. 29, 2012

(51) Int. Cl.
*G09G 5/10* (2006.01)

(52) U.S. Cl.
USPC ..... 345/690; 345/212; 345/214

(58) Field of Classification Search
None
See application file for complete search history.

(56) References Cited

U.S. PATENT DOCUMENTS 5,483,261 A 1/1996 Yasutake
5,488,204 A 1/1996 Mead et al.
5,825,352 A 10/1998 Bisset et al.
5,835,079 A 11/1998 Shieh
5,880,411 A 3/1999 Gillespie et al.
6,188,391 B1 2/2001 Seely et al.
6,310,610 B1 10/2001 Beaton et al.
6,323,846 B1 11/2001 Westerman et al.
6,690,387 B2 2/2004 Zimmerman et al.
7,015,894 B2 3/2006 Morohoshi
7,184,064 B2 2/2007 Zimmerman et al.

(Continued)

FOREIGN PATENT DOCUMENTS

JP 2000-163031 A 6/2000
JP 2002-342033 A 11/2002

(Continued)

OTHER PUBLICATIONS

International Search Report mailed Oct. 4, 2011, for PCT Application No. PCT/US2011/037805, six pages.

(Continued)

*Primary Examiner* — Jason Olson
(74) *Attorney, Agent, or Firm* — Morrison & Foerster LLP

(57) ABSTRACT

Design criteria of display screens is provided that can be used in combination with particular inversion schemes and scanning orders of the display screens to reduce or eliminate visual artifacts that can be caused by the effects of capacitive coupling of voltage changes in one part of the display into other parts of the display. Using particular combinations of inversion schemes and scanning orders, together with particular design criteria for the display screen, can allow one type of effect, e.g., an increase or decrease in a brightness of a display pixel, caused by one type of coupling effect, such as a coupling between data lines, can be offset by the effect caused by another type of coupling effect, such as a coupling between pixel electrodes.

13 Claims, 20 Drawing Sheets

U.S. PATENT DOCUMENTS

| | | | | |
|---|---|---|---|---|
| 7,663,607 | B2 | 2/2010 | Hotelling et al. | |
| 8,031,153 | B2 * | 10/2011 | Kang et al. | 345/96 |
| 8,228,273 | B2 * | 7/2012 | Tsubata | 345/87 |
| 8,378,952 | B2 * | 2/2013 | Kim | 345/100 |
| 2003/0090452 | A1 | 5/2003 | Uchino et al. | |
| 2005/0219276 | A1 | 10/2005 | Nose et al. | |
| 2006/0026521 | A1 | 2/2006 | Hotelling et al. | |
| 2006/0197753 | A1 | 9/2006 | Hotelling | |
| 2008/0252587 | A1 | 10/2008 | Wang | |
| 2009/0179875 | A1 * | 7/2009 | Li et al. | 345/204 |
| 2010/0195004 | A1 | 8/2010 | Hotelling | |
| 2010/0315402 | A1 * | 12/2010 | Hashimoto | 345/211 |

FOREIGN PATENT DOCUMENTS

| | | | |
|---|---|---|---|
| WO | WO-2006/018800 | A1 | 2/2006 |
| WO | WO-2010/093697 | A1 | 8/2010 |
| WO | WO-2012/161700 | A1 | 11/2012 |

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

Rubine, D.H. (Dec. 1991). "The Automatic Recognition of Gestures," CMU-CS-91-202, Submitted in Partial Fulfillment of the Requirements for the Degree of Doctor of Philosophy in Computer Science at Carnegie Mellon University, 285 pages.

Rubine, D.H. (May 1992). "Combining Gestures and Direct Manipulation," CHI ' 92, pp. 659-660.

Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

* cited by examiner

Design Criteria: D-D Coupling Effect = 2 x P-P Coupling Effect

OFFSETTING MULTIPLE COUPLING EFFECTS IN DISPLAY SCREENS

This application is a United States National Stage Application under 35 U.S.C. §371 of International Patent Application No. PCT/US2011/037805, filed May 24, 2011, which is incorporated by reference in its entirety for all purposes.

FIELD OF THE DISCLOSURE

This relates generally to display screen scanning inversions schemes and scanning orders, and more particularly, to display screen designs used with particular combinations of inversion schemes and scanning orders to offset multiple types of capacitive coupling effects occurring during the scanning of the display screen.

BACKGROUND OF THE DISCLOSURE

Display screens of various types of technologies, such as liquid crystal displays (LCDs), organic light emitting diode (OLED) displays, etc., can be used as screens or displays for a wide variety of electronic devices, including such consumer electronics as televisions, computers, and handheld devices (e.g., cellular telephones, audio and video players, gaming systems, and so forth). LCD devices, for example, typically provide a flat display in a relatively thin package that is suitable for use in a variety of electronic goods. In addition, LCD devices typically use less power than comparable display technologies, making them suitable for use in battery-powered devices or in other contexts where it is desirable to minimize power usage.

LCD devices typically include multiple picture elements (pixels) arranged in a matrix. The pixels may be driven by scanning line and data line circuitry to display an image on the display that can be periodically refreshed over multiple image frames such that a continuous image may be perceived by a user. Individual pixels of an LCD device can permit a variable amount light from a backlight to pass through the pixel based on the strength of an electric field applied to the liquid crystal material of the pixel. The electric field can be generated by a difference in potential of two electrodes, a common electrode and a pixel electrode. In some LCDs, such as electrically-controlled birefringence (ECB) LCDs, the liquid crystal can be in between the two electrodes. In other LCDs, such as in-plane switching (IPS) and fringe-field switching (FFS) LCDs, the two electrodes can be positioned on the same side of the liquid crystal. In many displays, the direction of the electric field generated by the two electrodes can be reversed periodically. For example, LCD displays can scan the pixels using various inversion schemes, in which the polarities of the voltages applied to the common electrodes and the pixel electrodes can be periodically switched, i.e., from positive to negative, or from negative to positive. As a result, the polarities of the voltages applied to various lines in a display panel, such as data lines used to charge the pixel electrodes to a target voltage, can be periodically switched according to the particular inversion scheme.

SUMMARY

The following description includes examples of design criteria of display screens that can be used in combination with particular inversion schemes and scanning orders of the display screens to reduce or eliminate visual artifacts that can be caused by capacitive coupling of voltage changes in one part of the display into other parts of the display. For example, a capacitive coupling between two pixel electrodes in adjacent rows of a display can allow a voltage change on one pixel electrode to affect the voltage on the adjacent pixel electrode. In another example, a capacitive coupling between adjacent data line can allow a voltage change on one data line to affect the voltage on the adjacent data line. Using particular combinations of inversion schemes and scanning orders, together with particular design criteria for the display screen, can allow one type of effect, e.g., an increase or decrease in a brightness of a display pixel, caused by one type of coupling effect, such as the coupling between data lines, can be offset by the effect caused by another type of coupling effect, such as the coupling between pixel electrodes.

DETAILED DESCRIPTION

In the following description of example embodiments, reference is made to the accompanying drawings which form a part hereof, and in which it is shown by way of illustration specific embodiments in which embodiments of the disclosure can be practiced. It is to be understood that other embodiments can be used and structural changes can be made without departing from the scope of the embodiments of this disclosure.

The following description includes examples of design criteria of display screens that can be used in combination with particular inversion schemes and scanning orders of the display screens to reduce or eliminate visual artifacts that can be caused by capacitive coupling of voltage changes in one part of the display into other parts of the display. For example, a capacitive coupling between two pixel electrodes in adjacent rows of a display can allow a voltage change on one pixel electrode to affect the voltage on the adjacent pixel electrode. In another example, a capacitive coupling between adjacent data line can allow a voltage change on one data line to affect the voltage on the adjacent data line. Using particular combinations of inversion schemes and scanning orders, together with particular design criteria for the display screen, can allow one type of effect, e.g., an increase or decrease in a brightness of a display pixel, caused by one type of coupling effect, such as the coupling between data lines, can be offset by the effect caused by another type of coupling effect, such as the coupling between pixel electrodes.

Figure 1C:
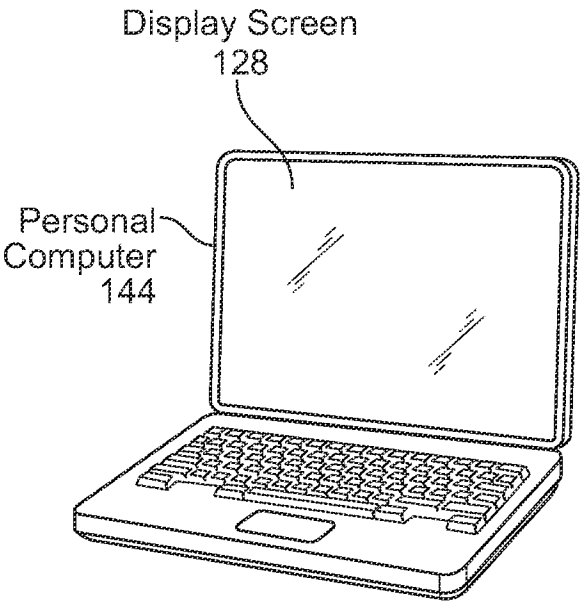
FIGS. 1A-1D illustrate an example mobile telephone, an example media player, an example personal computer, and an example display that each include an example display screen that can be designed and scanned according to embodiments of the disclosure.
Figure 1B:
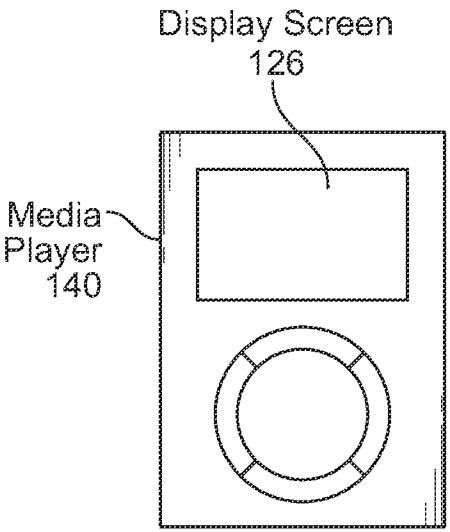
Figure 1A:
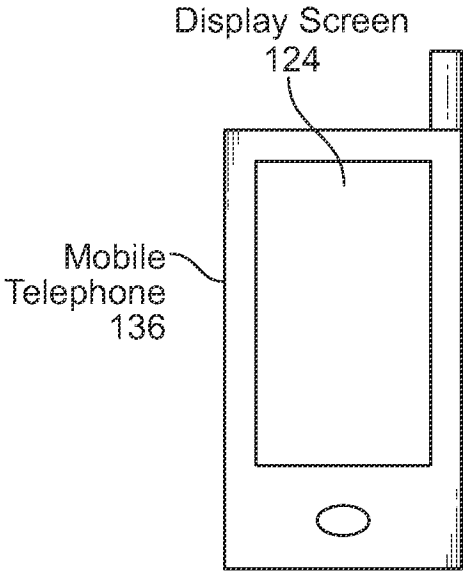
Figure 1D:
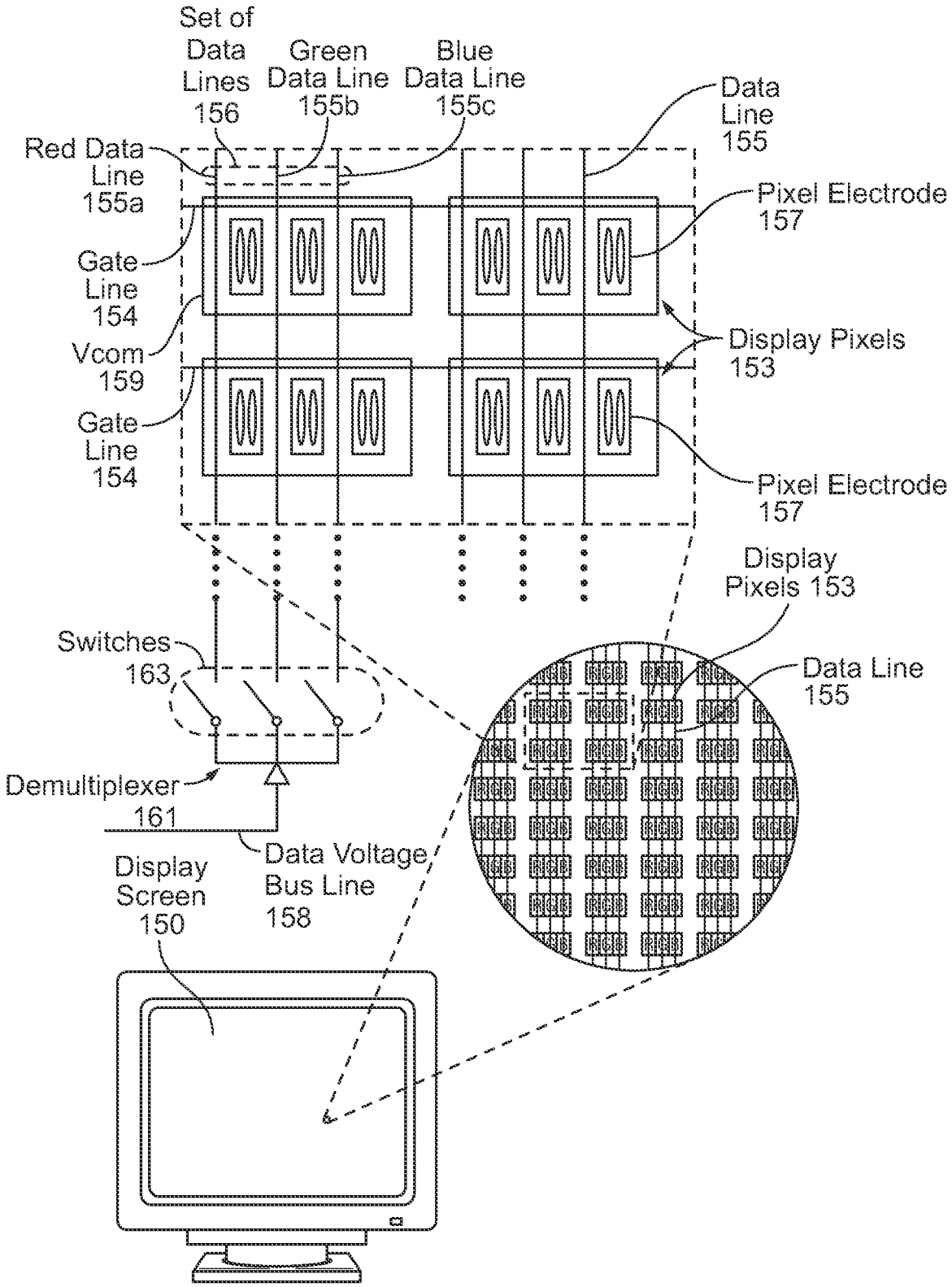

FIGS. 1A-1D show example systems that can include display screens that can be scanned according to embodiments of the disclosure. FIG. 1A illustrates an example mobile telephone 136 that includes a display screen 124. FIG. 1B illustrates an example digital media player 140 that includes a display screen 126. FIG. 1C illustrates an example personal computer 144 that includes a display screen 128. FIG. 1D illustrates an example display screen 150, such as a standalone display. In some embodiments, display screens 124, 126, 128, and 150 can be touch screens that include touch sensing circuitry. In some embodiments, touch sensing circuitry can be integrated into the display pixels.

FIG. 1D illustrates some details of example display screen 150. FIG. 1D includes a magnified view of display screen 150 that shows multiple display pixels 153, each of which can include multiple display sub-pixels, such as red (R), green (G), and blue (B) sub-pixels in an RGB display. Although various embodiments are described with respect to display pixels, one skilled in the art would understand that the term display pixels (or simply "pixels") can be used interchangeably with the term display sub-pixels (or simply "sub-pixels") in embodiments in which display pixels include multiple sub-pixels. For example, some embodiments directed to RGB displays can include display pixels divided into red, green, and blue sub-pixels. In other words, each sub-pixel can be a red (R), green (G), or blue (B) sub-pixel, with the combination of all three R, G, and B sub-pixels forming one display pixel.

Display screen 150 can include data lines 155 that can run vertically through the display screen, such that each display pixel in a column of display pixels can include a set 156 of three data lines (an R data line 155*a*, a G data line 155*b*, and a B data line 155*c*) corresponding to the three sub-pixels of each display pixel. Display pixels 153 can include pixel electrodes 157, each of which can correspond to one of the sub-pixels, for example. Each display pixel can include a common electrode (Vcom) 159 that can be used in conjunction with pixel electrodes 157 to create an electrical potential across a pixel material (not shown). Varying the electrical potential across the pixel material can correspondingly vary an amount of light emanating from the sub-pixel. In some embodiments, for example, the pixel material can be liquid crystal. A common electrode voltage can be applied to a Vcom 159 of a display pixel, and a data voltage can be applied to a pixel electrode 157 of a sub-pixel of the display pixel through the corresponding data line 155. A voltage difference between the common electrode voltage applied to Vcom 159 and the data voltage applied to pixel electrode 157 can create the electrical potential across the liquid crystal of the sub-pixel. The electrical potential between Vcom 159 and pixel electrode 157 can generate an electric field through the liquid crystal, which can cause inclination of the liquid crystal molecules to allow polarized light from a backlight (not shown) to emanate from the sub-pixel with a luminance that depends on the strength of the electric field (which can depend on the voltage difference between the applied common electrode voltage and data voltage). In other embodiments, the pixel material can include, for example, a light-emitting material, such as can be used in organic light emitting diode (OLED) displays.

Display screen 150 can include gate lines 154 that each run through a horizontal row of display pixels 153. Gate lines 154 can be controlled by a display driver or host video driver (not shown) to scan the rows of display pixels 153 to update pixel electrodes 157 with the data voltages by, for example, applying a gate voltage to one of the gate lines such that the pixel electrodes in the corresponding row can be connected to data lines 155. The order in which the rows of display pixels are scanned, and the polarity of the data voltages applied to the data lines during the updating of particular rows of display pixels, can depend on a particular scanning method that is used by the display driver.

In some scanning methods, the direction of the electric field across the pixel material can be reversed periodically. In LCD displays, for example, periodically switching the direction of the electric field can help prevent the molecules of liquid crystal from becoming stuck in one direction. Switching the electric field direction can be accomplished by reversing the polarity of the electrical potential between the pixel electrode and the Vcom. In other words, a positive potential from the pixel electrode to the Vcom can generate an electric field across the liquid crystal in one direction, and a negative potential from the pixel electrode to the Vcom can generate an electric field across the liquid crystal in the opposite direction. In some scanning methods, switching the polarity of the potential between the pixel electrode and the Vcom can be accomplished by switching the polarities of the voltages applied to the pixel electrode and the Vcom. For example, during an update of an image in one frame, a positive voltage can be applied to the pixel electrode and a negative voltage can be applied to the Vcom. In a next frame, a negative voltage can be applied to the pixel electrode and a positive voltage can be applied to the Vcom. One skilled in the art would understand that switching the polarity of the potential between the pixel electrode and the Vcom can be accomplished without switching the polarity of the voltage applied to either or both of the pixel electrode and Vcom. In this regard, although example embodiments are described herein as switching the polarity of voltages applied to data lines, and correspondingly, to pixel electrodes, it should be understood that reference to positive/negative voltage polarities can represent relative voltage values. For example, an application of a negative polarity voltage to a data line, as described herein, can refer to application of a voltage with a positive absolute value (e.g., +1V) to the data line, while a higher voltage is being applied to the Vcom, for example. In other words, in some cases, a negative polarity potential can be created between the pixel electrode and the Vcom by applied positive (absolute value) voltages to both the pixel electrode and the Vcom, for example.

The brightness (or luminance) of the corresponding pixel or sub-pixel depends on the magnitude of the difference between the pixel electrode voltage and the Vcom voltage. For example, the magnitude of the difference between a pixel electrode voltage of +2V and a Vcom voltage of −3V is 5V. Likewise, the magnitude of the difference between a pixel electrode voltage of −2V and a Vcom voltage of +3V is also 5V. Therefore, in this example, switching the polarities of the pixel electrode and Vcom voltages from one frame to the next would not change the brightness of the pixel or sub-pixel.

Figure 2A:
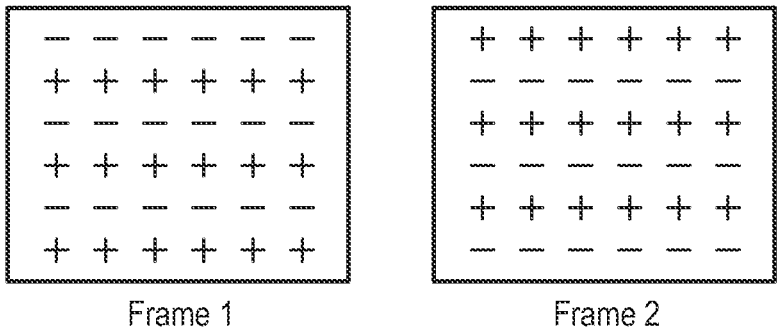
FIGS. 2A-C illustrate example line inversions schemes according to various example embodiments.
Figure 2B:
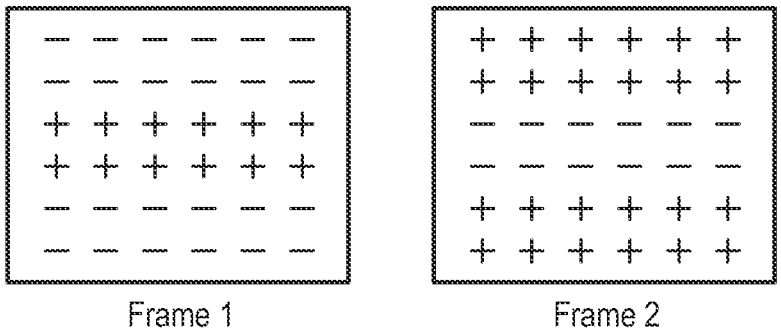
Figure 2C:
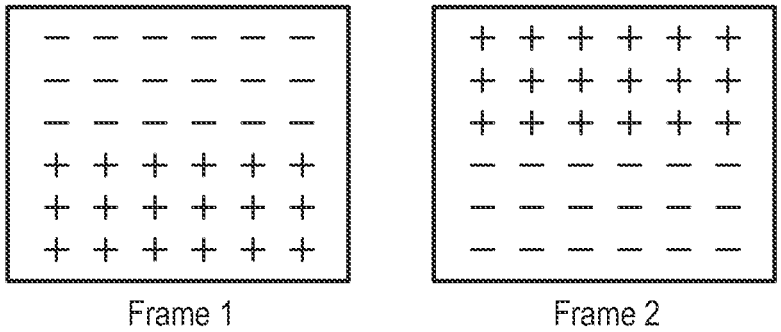

Various inversion schemes can be used to periodically switch the polarities of the pixel electrodes and the Vcoms. FIGS. 2A-C illustrate example line inversions schemes according to various example embodiments. FIG. 2A illustrates an example single line inversion scheme. In a single line inversion scheme, for example, when the scanning of a first frame is completed, the location of the positive and negative polarities on the pixel electrodes can be in a pattern of rows of the display that alternates every single row, e.g., the first row at the top of the display screen having negative polarities, the second row from the top having positive polarities, the third row from the top having negative polarities, etc. In a subsequent frame, such as the second frame, the pattern of voltage polarities can be reversed, e.g., the first row with positive polarities, the second row with negative polarities, etc.

During the scanning operation in single line inversion, the rows can be updated in one of various different scanning orders. For example, the rows can be updated in a scanning order that is the same as the order of the position of the rows from a first row at the top of the display screen to a last row at the bottom of the display screen. For example, the first row at the top of the display can be updated first, then the second row from the top can be updated second, then the third row from the top can be updated third, etc. In this way, there can be a repeating timing pattern of voltage polarity swings on the data lines during the scanning operation. In other words, repeatedly switching the voltages on the data lines from positive to negative to positive to negative, etc., during the scanning operation results in a repeating timing pattern of positive and negative voltage swings. In single line inversion, for example, there is one positive voltage swing after one row is updated, and one negative voltage swing after the next row in the scanning order is updated. Thus, the timing pattern of positive/negative voltage swings repeats after the updating of each block of two adjacent rows in single line inversion using a scanning order that updates the rows sequentially in order of position.

In some line inversion schemes, the location of the positive and negative polarities on the pixel electrodes can be in a pattern of rows of the display that alternates every two rows (for 2-line inversion), every three rows (for 3-line inversion), every four rows (for 4-line inversion), etc. FIG. 2B illustrates an example 2-line inversion scheme according to various embodiments. In a 2-line inversion scheme, for example, when the scanning of a first frame is completed, the location of the positive and negative polarities on the pixel electrodes can be in a pattern of rows of the display that alternates every two rows, e.g., the first and second rows at the top of the display screen having negative polarities, the third and fourth rows from the top having positive polarities, the fifth and sixth rows from the top having negative polarities, etc. In a subsequent frame, such as the second frame, the pattern of voltage polarities can be reversed, e.g., the first and second rows with positive polarities, the third and fourth rows with negative polarities, etc.

FIG. 2C illustrates an example 3-line inversion scheme according to various embodiments. In general, the location of positive and negative polarities on the pixel electrodes in an M-line inversion scheme can alternate every M rows.

Figure 3A:
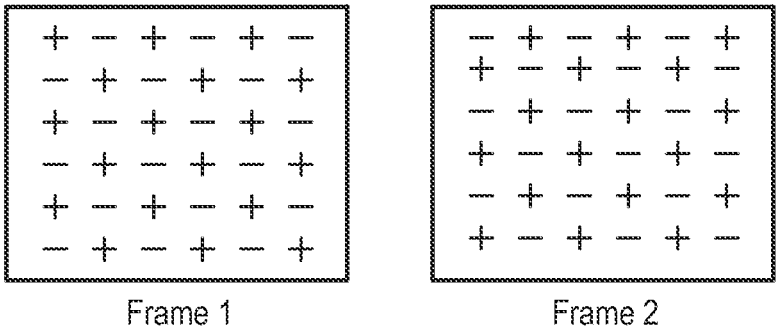
FIGS. 3A-C illustrate example dot inversions schemes according to various example embodiments.
Figure 3B:
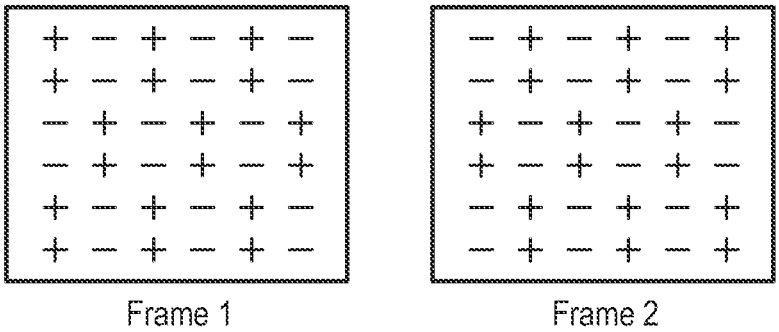
Figure 3C:
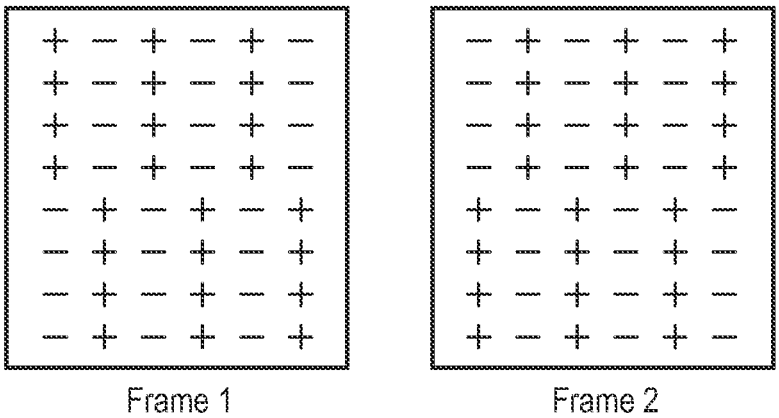

FIGS. 3A-C illustrate example dot inversions schemes according to various example embodiments. FIG. 3A illustrates an example single dot inversion scheme. In a single dot inversion scheme, for example, when the scanning of a first frame is completed, the location of the positive and negative polarities on the pixel electrodes can be in a pattern shown in FIG. 3A. FIGS. 3B and 3C illustrate example 2-dot and 4-dot inversion schemes, respectively, according to various example embodiments.

Voltage swings on the data lines in an M-line (and M-dot) inversion scheme can repeat every 2M rows when a scanning order of updating rows sequentially in order of position is used. In other words, there is one positive voltage swing after M rows are updated, and one negative voltage swing after the next M rows in the scanning order are updated. Thus, the timing pattern of positive and negative changes in voltage polarity repeats after the scanning of each block of 2M adjacent rows in M-line inversion.

In some reordered M-line (and M-dot) inversion schemes, the location of the resulting pattern of alternating positive and negative polarities on the pixel electrodes can be the same pattern as in regular single line (or single dot) inversion described above, i.e., alternating polarity every single row. However, while the regular line (or dot) inversion schemes described above can update the rows in the sequential order of row position, in a reordered line (or dot) inversion scheme, the rows can be updated in an order that is not sequential. In one example reordered 4-line inversion scheme, the scanning order can update four rows in a block of eight rows with positive polarity and update the other four rows in the block with negative polarity. However, unlike regular 4-line inversion, the scanning order of reordered 4-line inversion can update, for example, update rows 1, 3, 5, and 7 with positive polarity voltages, and then update rows 2, 4, 6, and 8 with negative polarity voltages. Therefore, in this example reordered 4-line inversion scheme, the timing pattern of positive/negative voltage swings can repeat after the updating of 8 rows (i.e., after the updating of 2M rows for a reordered M-line inversion scheme), which is similar to regular 4-line inversion. However, the pattern of the location of alternating positive and negative pixel electrodes can repeat every single row, which is similar to regular single line inversion. In this way, for example, reordered line inversion schemes can reduce the number of voltage polarity swings on the data lines during the scanning of a single frame, while maintaining a row-by-row location of alternating polarities. In the context of this document, in a reordered M-line inversion scheme, M is an integer greater than one.

Thus, the particular order and location in which voltages of different polarities are applied to the pixel electrodes of sub-pixels of a display can depend on a combination of the particular scanning order and the particular inversion scheme being used to scan the display. In some displays, the voltage polarity patterns of the particular inversion schemes can correspond to the data voltages applied to each display pixel (e.g., each "+" or "−" can correspond to all of the sub-pixels of a single display pixel). In other displays, such as in the various example embodiments described herein, the voltage polarity patterns of the inversion schemes can correspond to the data voltages applied to each sub-pixel.

For example, referring again to FIG. 1D, the data lines that correspond to multiple sub-pixels of a display pixel, such as R data line 155*a*, G data line 155*b*, and B data line 155*c*, can be operated sequentially during an update of the pixel. For example, the display driver or host video driver (not shown)

can multiplex an R data voltage, a G data voltage, and a B data voltage onto a single data voltage bus line 158 in a particular sequence, and then a demultiplexer 161 in the border region of the display can demultiplex the R, G, and B data voltages to apply the data voltages to data lines 155*a*, 155*b*, and 155*c* in the particular sequence. Each demultiplexer 161 can include three switches 163 that can open and close according to the particular sequence of sub-pixel charging for the display pixel. In an R-G-B sequence, for example, data voltages can be multiplexed onto data voltage bus line 158 such that R data voltage is applied to R data line 155*a* during a first time period, G data voltage is applied to G data line 155*b* during a second time period, and B data voltage is applied to B data line 155*c* during a third time period. Demultiplexer 161 can demultiplex the data voltages in the particular sequence by closing switch 163 associated with R data line 155*a* during the first time period when R data voltage is being applied to data voltage bus line 158, while keeping the green and blue switches open such that G data line 155*b* and B data line 155*c* are at a floating potential during the application of the R data voltage to the R data line. In this way, for example, the red data voltage can be applied to the pixel electrode of the red sub-pixel during the first time period. During the second time period, when G data voltage is being applied to G data line 155*b*, demultiplexer 161 can open the red switch 163, close the green switch 163, and keep the blue switch 163 open, thus applying the G data voltage to the G data line, while the R data line and B data line are floating. Likewise, the B data voltage can be applied during the third time period, while the G data line and the R data line are floating.

While applying a voltage to the data line of a particular sub-pixel can charge the sub-pixel (e.g., the pixel electrode of the sub-pixel) to the voltage level of the applied voltage, applying a voltage to one data line can affect the voltage on floating data lines, for example, because a capacitance existing between data lines can allow voltage changes on one data line to be coupled to other data lines. This data-to-data capacitive coupling effect will now be described in reference to FIGS. 4-6.

Figure 4:
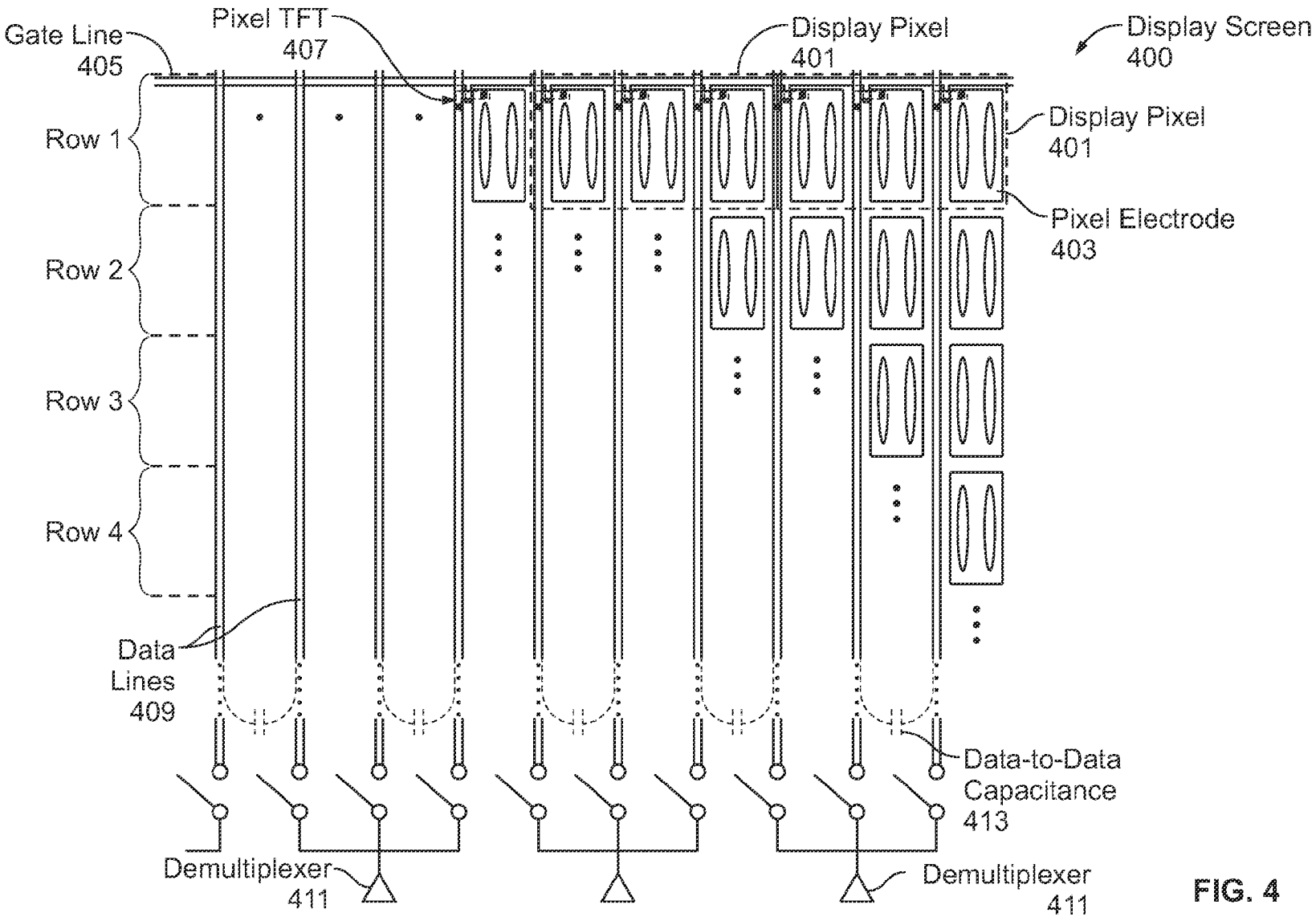
FIG. 4 illustrates a portion of an example display screen according to various embodiments.

FIG. 4 illustrates a portion of an example display screen 400 according to various embodiments. Display screen 400 can include multiple rows, such as row 1, row 2, row 3, row 4, etc., of display pixels 401. Each display pixel 401 can include three pixel electrodes 403 that each can correspond to a sub-pixel of the display pixel. Gate lines 405 can be used to scan the rows by applying gate voltages to the gate lines in a scanning order, each gate voltage switching on a pixel thin-film transistor (TFT) 407 in each sub-pixel in the row to connect the sub-pixel's pixel electrode 403 to a corresponding data line 409. Demultiplexers 411 can be used to apply data voltages to particular sub-pixels of each display pixel 401 through the corresponding data lines 409. As described above, for example, as a data voltage is applied to the data line corresponding to one sub-pixel of a particular display pixel, the data lines corresponding to the other sub-pixels of the display pixel can be electrically floating.

Each data line can be a conductive line running through an entire vertical column of sub-pixels, and a capacitance can exist between adjacent data lines, which is shown in FIG. 4 as a data-to-data capacitance 413. Data-to-data capacitance 413 can result in a capacitive coupling that can allow a voltage change in a charging data line to change the voltage on adjacent floating data lines, which can make the sub-pixels corresponding to the floating data lines appear either brighter or darker depending on whether the voltage change on the charging data line is in the same direction or opposite direction, respectively, as the polarity of the floating data line voltage. In addition, the amount of voltage change on the floating data line can depend on the amount of the voltage change on the charging data line.

By way of example, a negative data voltage, e.g., −2V, may be applied to data line A during the scan of a first row. Then, during the scan of the second row, a positive data voltage, e.g., +2V, may be applied to data line A, thus swinging the voltage on data line A from −2V to +2V, i.e., a positive voltage change of +4V. Voltages on floating data lines surrounding data line A can be increased by this positive voltage swing during the charging of data line A in the scan of the second row. For example, the positive swing on data line A can increase the voltage of an adjacent data line B floating at a positive voltage, thus, increasing the magnitude of the positive floating voltage and making the sub-pixel corresponding to data line B appear brighter. Likewise, the positive voltage swing on data line A can increase the voltage of an adjacent data line C floating at a negative voltage, thus, decreasing the magnitude of the negative floating voltage and making the sub-pixel corresponding to sub-pixel C appear darker. Thus, the appearance of visual artifacts of brighter or darker sub-pixels can depend on, for example, the occurrence of large voltage changes on one or more data lines during scanning of a display and the polarity of surrounding data lines with floating voltages during the large voltage changes.

In addition, the appearance of visual artifacts can depend on the particular sequence in which the data voltages are applied. Further to the example above, after a data voltage is applied to data line A, a data voltage may be applied to data line B (data line B being next in sequence). In this case, the effect of the voltage swing on data line A, i.e., the increase in the voltage on data line B, can be "overwritten" by the subsequent charging of data line B.

The amount of increase and decrease in brightness caused in a sub-pixel connected to one data line (victim data line) by the data-to-data capacitive coupling of a voltage change in another data line (aggressor data line) can depend on the value of the data-to-data capacitance between the data lines (i.e., mutual capacitance) and the self-capacitance of the victim data line:

$$\Delta V_{victimDL} = \text{DtoD_cap_ratio} \times \Delta V_{aggressorDL} \tag{1}$$

$$\text{where: DtoD_cap_ratio} = \frac{\text{datatodata_cap}}{\text{self_cap}_{victimDL}}$$

where:

$\Delta V_{victimDL}$ is the change in voltage of the victim data line, $\Delta V_{aggressorDL}$ is the change in voltage of the aggressor data line, datatodata_cap is the data-to-data capacitance between the victim data line and the aggressor data line, and $\text{self_cap}_{victimDL}$ is the self-capacitance of the victim data line The DtoD_cap_ratio is a capacitance ratio of the data-to-data capacitance and the self-capacitance of the victim data line, which can depend on various factors, or design criteria of the display screen, such as distance between the data lines, the dimensions of the data lines, the proximity of other conductive structures and dielectric structures to the data lines, the material properties of the data lines and other structures, etc., as one skilled in the art would readily understand.

Figure 5:
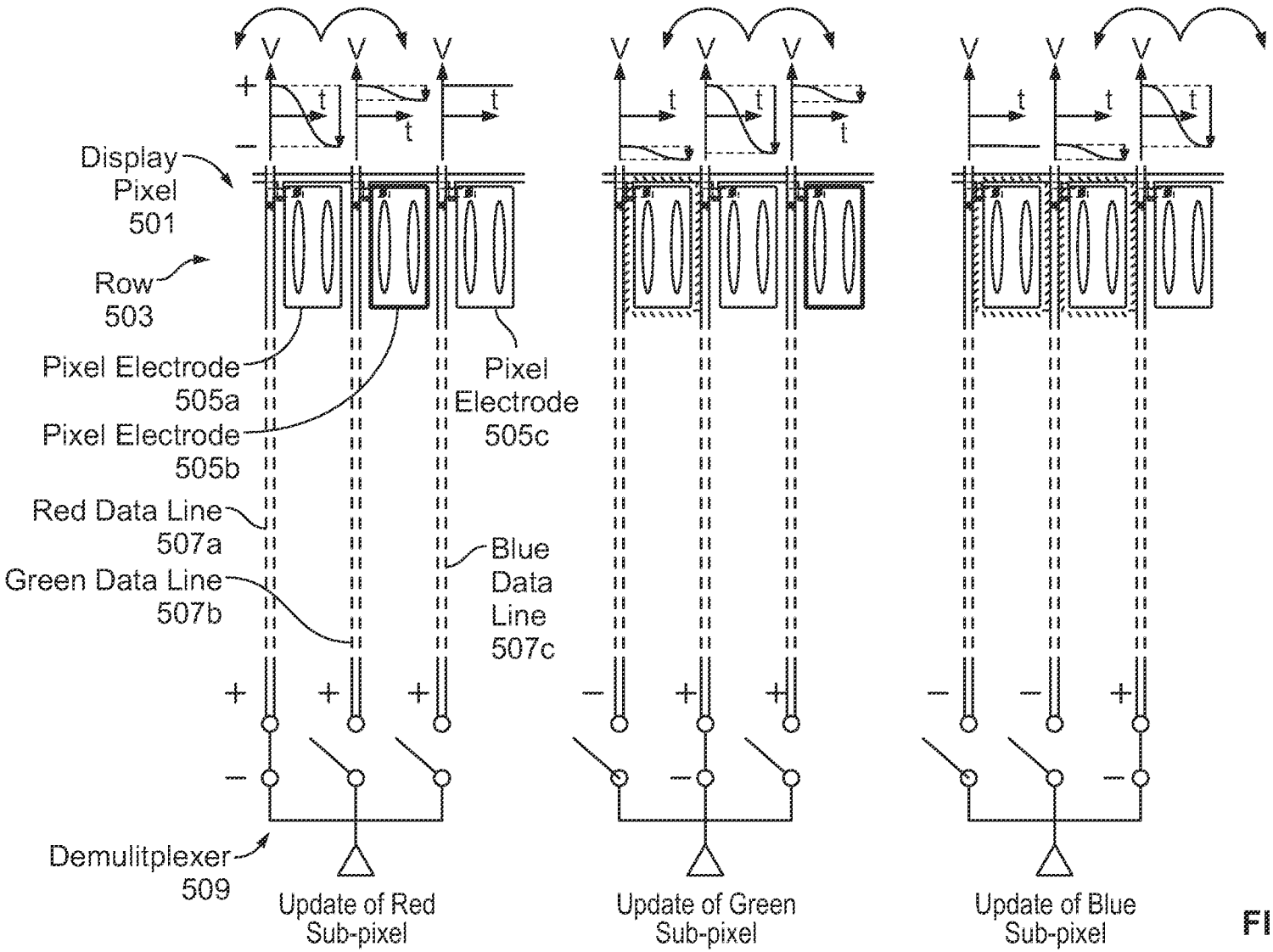
FIG. 5 illustrates an example updating of a display pixel in a row during a scanning of the row according to various embodiments.

FIG. 5 illustrates an example updating of a display pixel 501 in a row 503 during a scanning of the row. Display pixel 501 can include a pixel electrode 505*a* of a red sub-pixel that corresponds to a red data line 507*a*, a pixel electrode 505*b* of a green sub-pixel that corresponds to a green data line 507*b*, and a pixel electrode 505*c* of a blue sub-pixel that corresponds to a blue data line 507*c*. A demultiplexer 509 can apply target data voltages to the data lines in an RGB sequence. In this example, at the beginning of the updating of display pixel 501, the polarity of the voltage on each data line can be positive (represented by "+" signs next to each data line during the update of red sub-pixel). In other words, positive polarity voltages were applied to data lines 507*a-c* during the scan of the previous row in the scanning order, thus, the positive voltages can remain on the data lines at the beginning of the updating of row 503.

The voltages on pixel electrodes 505*a-c* are represented by voltage graphs above to each pixel electrode in FIG. 5, which show the voltage on the pixel electrode during updating of the red, green, and blue sub-pixels. During the update of the red sub-pixel, a negative target data voltage can be applied to red data line 507*a* (represented by the "–" sign next to the closed switch of the demultiplexer that connects to the red data line). The application of a negative data voltage to red data line 507*a* can cause a large, negative swing in the voltage on the red data line as shown, which is represented in the voltage graph by a large down arrow. Due to effects such as the capacitance coupling resulting from the data-to-data capacitance described above, for example, the large negative voltage swing of red data line 507*a* can cause a corresponding negative voltage swing in adjacent data lines such as green data line 507*b*. This effect on the voltages on adjacent data lines can be significantly smaller in magnitude, therefore, the voltage graph of green data line 507*b* shows a slight negative change, which is represented in the voltage graph by a small down arrow, during the update of the red sub-pixel. Because pixel electrode 505*b* can be connected to green data line 507*b* during the update of the red sub-pixel, the change in the voltage on the green data line can result in a change in the voltage on pixel electrode 505*b*. As described above, the luminance of a sub-pixel associated with a pixel electrode can depend on the magnitude of the pixel voltage. The negative voltage change in pixel electrode 505*b* caused by the large negative voltage swing in red data line 507*a* can decrease the magnitude of the voltage of pixel electrode 505*b*. Therefore, the effect of the negative voltage swing on red data line 507*a* can be a decrease in the luminance, e.g., brightness, of the green sub-pixel of pixel electrode 505*b*. The decrease in brightness of the green sub-pixel of pixel electrode 505*b* is represented in FIG. 5 by a thick, dark border of the green sub-pixel.

During the update of the green sub-pixel, a negative target data voltage can be applied to green data line 507*b*, which can overwrite the erroneous decrease in brightness of the green sub-pixel (thus, pixel electrode 505*b* corresponding to the green sub-pixel is shown with normal thickness borders during the update of the green sub-pixel). The updating of the green sub-pixel can result in a large, negative voltage swing on the green data line, which can cause a corresponding negative change in the voltages on red data line 507*a* and blue data line 507*c*. The negative change in voltage on blue data line 507*c* can decrease the magnitude of the voltage on the blue sub-pixel, resulting in a decrease in the brightness of the blue sub-pixel. However, the large, negative voltage swing on green data line 507*b* can result in an increase in the magnitude of the voltage on red data line 507*a* (because the polarity of the voltage on the red sub-pixel, i.e., negative, is the same as the direction of the change in voltage on the red data line, i.e., negative), which can result in an increase in the brightness of the red sub-pixel. The increase in brightness is shown in FIG. 5 with hatch marks surrounding pixel electrode 505*a*.

During the update of the blue sub-pixel, a negative target data voltage applied to blue data line 507*c* can overwrite the erroneous decrease in the brightness of the blue sub-pixel, and can cause an increase in the brightness of the green sub-pixel.

Figure 6:
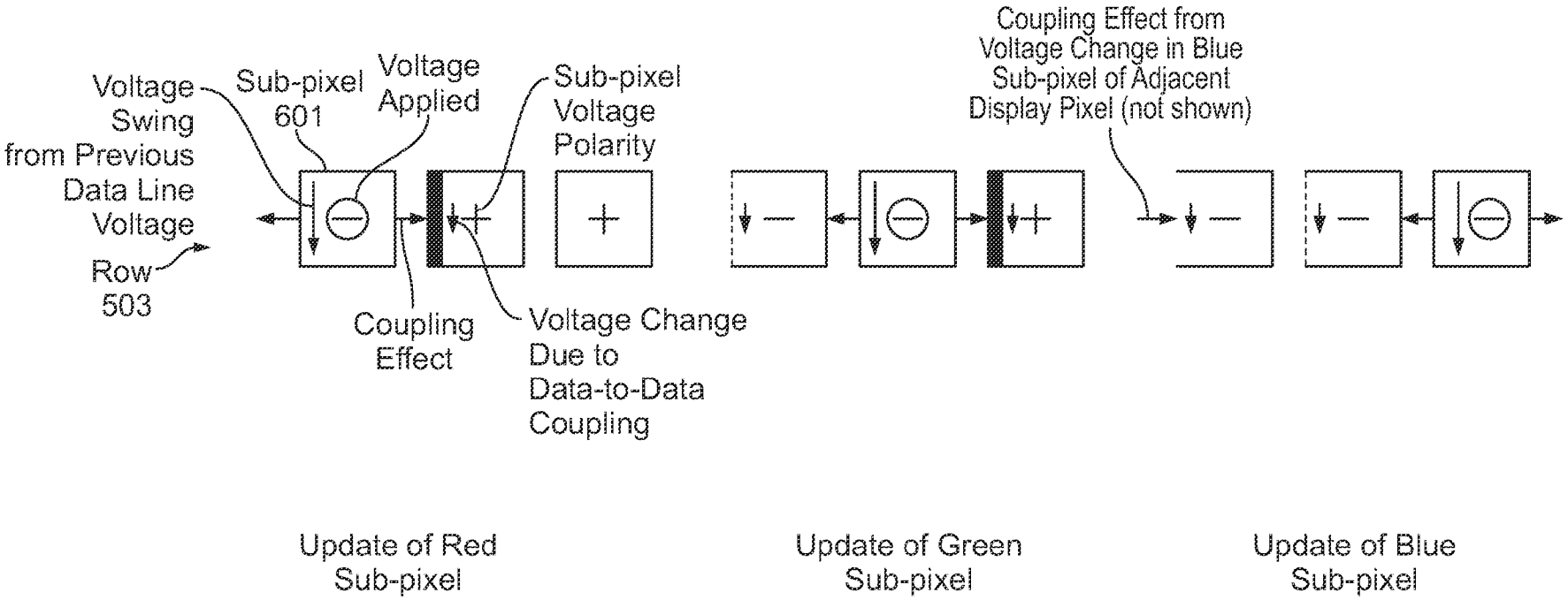
FIG. 6 shows another representation of the example scanning operation shown in FIG. 5.

FIG. 6 shows another representation of the example scanning operation shown in FIG. 5. Specifically, FIG. 6 illustrates a simplified notation for describing various effects on sub-pixel brightness resulting from data-to-data capacitance coupling that can occur during scanning operations. The notation illustrated in FIG. 6 will be adopted below in the descriptions of additional example embodiments.

FIG. 6 illustrates row 503 including sub-pixels 601 corresponding to the sub-pixels of pixel electrodes 505*a-c* of FIG. 5. Sub-pixel voltage polarities associated with each sub-pixel 601 are shown in FIG. 6. The sub-pixel voltage polarities correspond to the polarities of the voltages on pixel electrodes 505*a-c* shown in FIG. 5. FIG. 6 illustrates the voltage polarities on the sub-pixels 601 of display pixel 501 at the beginning of the update of row 503. As described above, during the update of row 503, a target data voltage is applied to the pixel electrode (i.e., pixel electrode 505*a*) of sub-pixel 401 in display pixel 501. The direct application of voltage to a pixel electrode is illustrated in the figures with the notation of a circle around the polarity sign of the applied voltage in the sub-pixel. A large voltage swing on corresponding data line of the sub-pixel due to a direct application of voltage to the pixel electrode is illustrated in the figures with the notation of a large up-arrow, corresponding to a positive voltage swing, or a large down-arrow, corresponding to a negative voltage swing, in the sub-pixel. The large up or down arrow positioned to the left of the sub-pixel polarity sign represents a voltage swing on the corresponding data line (as described below, a large arrow positioned to the right of the sub-pixel polarity sign will be used to represent a voltage swing on the pixel electrode). The data-to-data capacitive coupling effect is represented in FIG. 6 by horizontal arrows from the sub-pixel being updated to the adjacent sub-pixels, and the voltage change in an adjacent sub-pixel du to data-to-data coupling is represented by a small up or down arrow positioned to the left of the voltage polarity sign in the affected sub-pixel.

Accordingly, the effect that the large, negative swing of the voltage on red data line 507*a* has on the voltage on green data line 507*b* is represented in the FIG. 6 by a small down-arrow to the left of the voltage polarity sign of the green sub-pixel. The corresponding decrease in brightness of the green sub-pixel is represented in FIG. 6 by the notation of a thick, dark left-hand border of the green sub-pixel.

An increase in the brightness of a sub-pixel resulting from the data-to-data capacitive coupling of a large voltage swing on one data line to another data line is represented by the notation of a dashed-line left-hand border of the affected sub-pixel. For example, during the update of the green sub-pixel, the increase in brightness of the red sub-pixel is represented in FIG. 6 by the dashed-line left-hand border of the red sub-pixel. In some cases, a sub-pixel can be affected by data-to-data capacitive coupling of voltage swings in two adjacent sub-pixels that can result in a further increase or decrease in brightness. For example, although not shown in FIG. 5, during the update of the blue sub-pixel shown in FIG. 6, a data-to-data capacitive coupling between the red data line of the display pixel and the blue data line in an adjacent display pixel can cause a further increase in the brightness of the red sub-pixel, which is represented in FIG. 6 by the removal of the left-hand border of the red sub-pixel during the update of the blue sub-pixel.

In addition to the data-to-data capacitive coupling effects described above, a capacitive coupling between pixel electrodes in adjacent rows can result in erroneous increases and/or decreases in sub-pixel brightness. Applying a voltage to a sub-pixel in one row of pixels can affect the voltages of sub-pixels in other rows of pixels. For example, a capacitance that can exist between pixel electrodes can allow a large voltage swing (for example, from a positive polarity voltage to a negative polarity voltage, or vice-versa) on the pixel electrode (which may be referred to herein as an "aggressor pixel electrode") to be coupled into a pixel electrode in an adjacent row, which can result in a change in the voltage of the pixel electrode in the adjacent row. The change in the voltage of the pixel electrode in the adjacent row can cause an erroneous increase or decrease in the brightness of the sub-pixel with the affected pixel electrode (which may be referred to herein as a "victim pixel electrode"). In some cases, the erroneous increase or decrease in victim pixel brightness can be detectable as a visual artifact in the displayed image. As will be apparent from the description below, some sub-pixels can be an aggressor during the update of the sub-pixel's row and can be a victim during the update of another row.

The amount of increase and decrease in brightness caused in a sub-pixel including one pixel electrode (victim pixel electrode) by the pixel-to-pixel capacitive coupling of a voltage change in another pixel electrode (aggressor pixel electrode) can depend on the value of the pixel-to-pixel capacitance between the pixel electrodes (i.e., mutual capacitance) and the self-capacitance of the victim pixel electrode:

$$\Delta V_{victimPE} = \text{PtoP_cap_ratio} \times \Delta V_{aggressorPE} \tag{2}$$

$$\text{where: PtoP_cap_ratio} = \frac{\text{pixeltopixel_cap}}{\text{self_cap}_{victimPE}}$$

$\Delta V_{victimPE}$ is the change in voltage of the victim pixel electrode, $\Delta V_{aggressorPE}$ is the change in voltage of the aggressor pixel electrode, pixeltopixel_cap is the pixel-to-pixel capacitance between the victim pixel electrode and the aggressor pixel electrode, and $\text{self_cap}_{victimPE}$ is the self-capacitance of the victim pixel electrode The PtoP_cap_ratio is a capacitance ratio of the pixel-to-pixel capacitance and the self-capacitance of the victim pixel electrode, which can depend on various factors, or design criteria of the display screen, such as distance between the pixel electrodes, the dimensions of the pixel electrodes, the proximity of other conductive structures and dielectric structures to the pixel electrodes, the material properties of the pixel electrodes and other structures, etc., as one skilled in the art would readily understand. This pixel-to-pixel capacitive coupling effect will now be described in reference to FIGS. 7-9.

Figure 7:
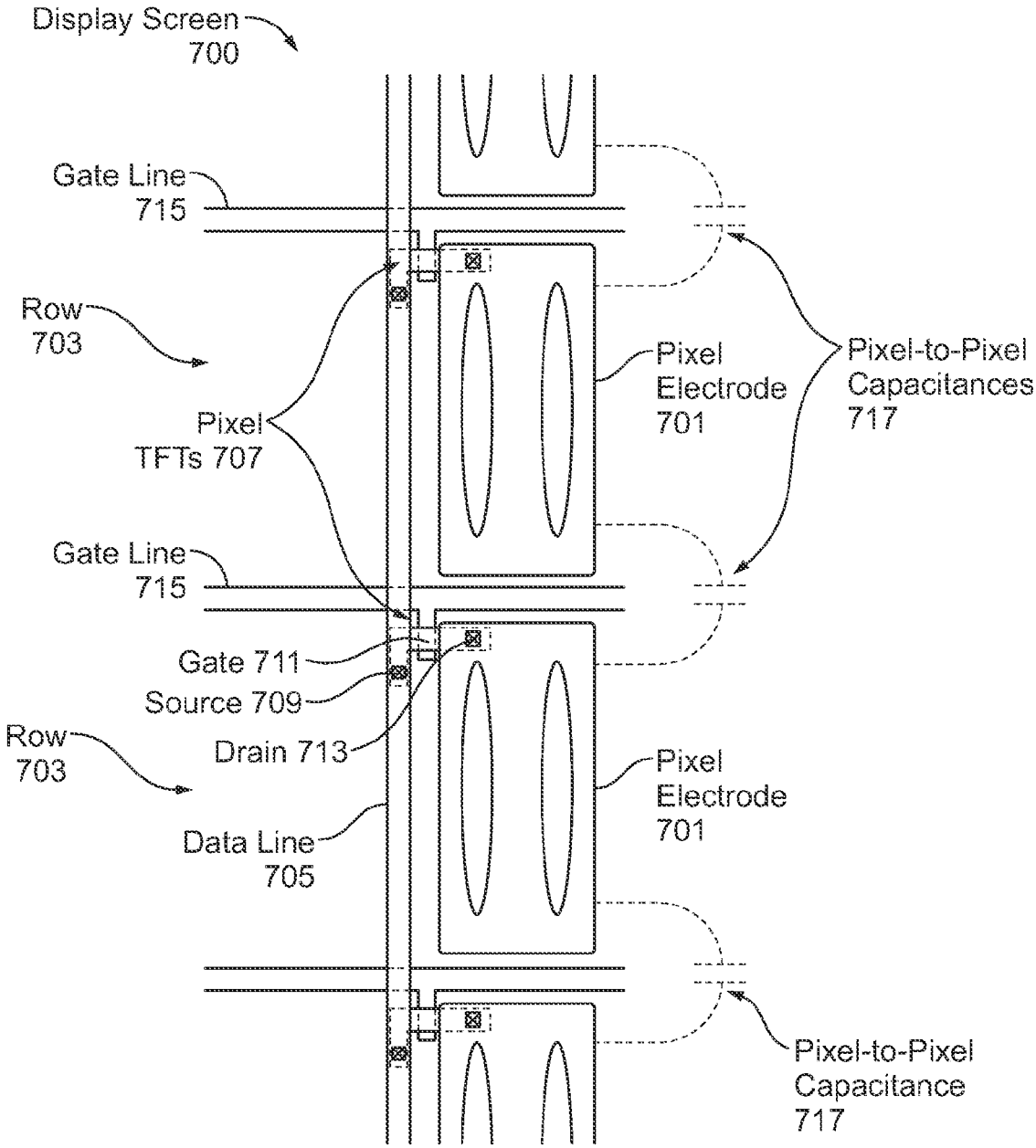
FIG. 7 illustrates an example arrangement of pixel electrodes in an example display screen according to various embodiments.

FIG. 7 illustrates an example arrangement of pixel electrodes 701 in an example display screen 700. Pixel electrodes 701 can have an arrangement similar to pixel electrodes 157 in FIG. 1D, for example, in which the pixel electrodes can be arranged in horizontal lines, such as rows 703. For the purpose of clarity other pixel electrodes in rows 703 of display screen 700 are not shown in this figure. Pixel electrodes 701 shown in FIG. 7 can each be associated with a data line 705, such as data line 155 in FIG. 1D. Each pixel TFT 707 can include a source 709 connected to data line 705, a gate 711, and a drain 713 connected to pixel electrode 701. Each pixel TFT 707 in one row 703 of pixels can be switched on by applying an appropriate gate line voltage to a gate line 715 corresponding to the row. During a scanning operation of display screen 700, a target voltage of each pixel electrode 701 in one row 703 can be applied individually to the pixel electrode by switching on pixel TFTs 707 of the of the row with the corresponding gate line 715 while the target voltages of each pixel electrode in the row are being applied to data lines 705.

To update all of the pixel electrodes 701 in display screen 700, thus refreshing an image frame displayed by the sub-pixels of the display screen, rows 703 can be scanned by applying the appropriate gate line voltages to gate lines 715 in a particular scanning order. For example, a scanning order can be sequential in order of position of rows 703 from a first row at the top of display screen 700 to a last row at the bottom of the display screen. In other words, the first row of the display can be scanned first, then the next adjacent row (i.e., the second row) can be scanned next, then the next adjacent row (i.e., the third row) can be scanned, etc. One skilled in the art would understand that other scanning orders can be used.

When a particular row 703 is being scanned to update the voltages on pixel electrodes 701 of the row with the target data voltages being applied to the data lines 705 during the scanning of the row, pixel TFTs 707 of the other rows can be switched off so that the pixel electrodes in the rows that are not being scanned remain disconnected from the data lines. In this way, data voltages on the data lines can be applied to a single row currently being scanned, while the voltages on the data lines are not applied directly to the pixel electrodes in the other rows.

However, updating the voltages of the pixel electrodes 701 of a particular row 703 can have an effect on the voltages of pixel electrodes in other rows. For example, a pixel-to-pixel capacitance 717 existing between adjacent pixel electrodes 701, for example, can allow voltage changes in one pixel electrode to affect the voltage values of adjacent pixel electrodes through a capacitance coupling between the pixel electrodes.

Figure 8:
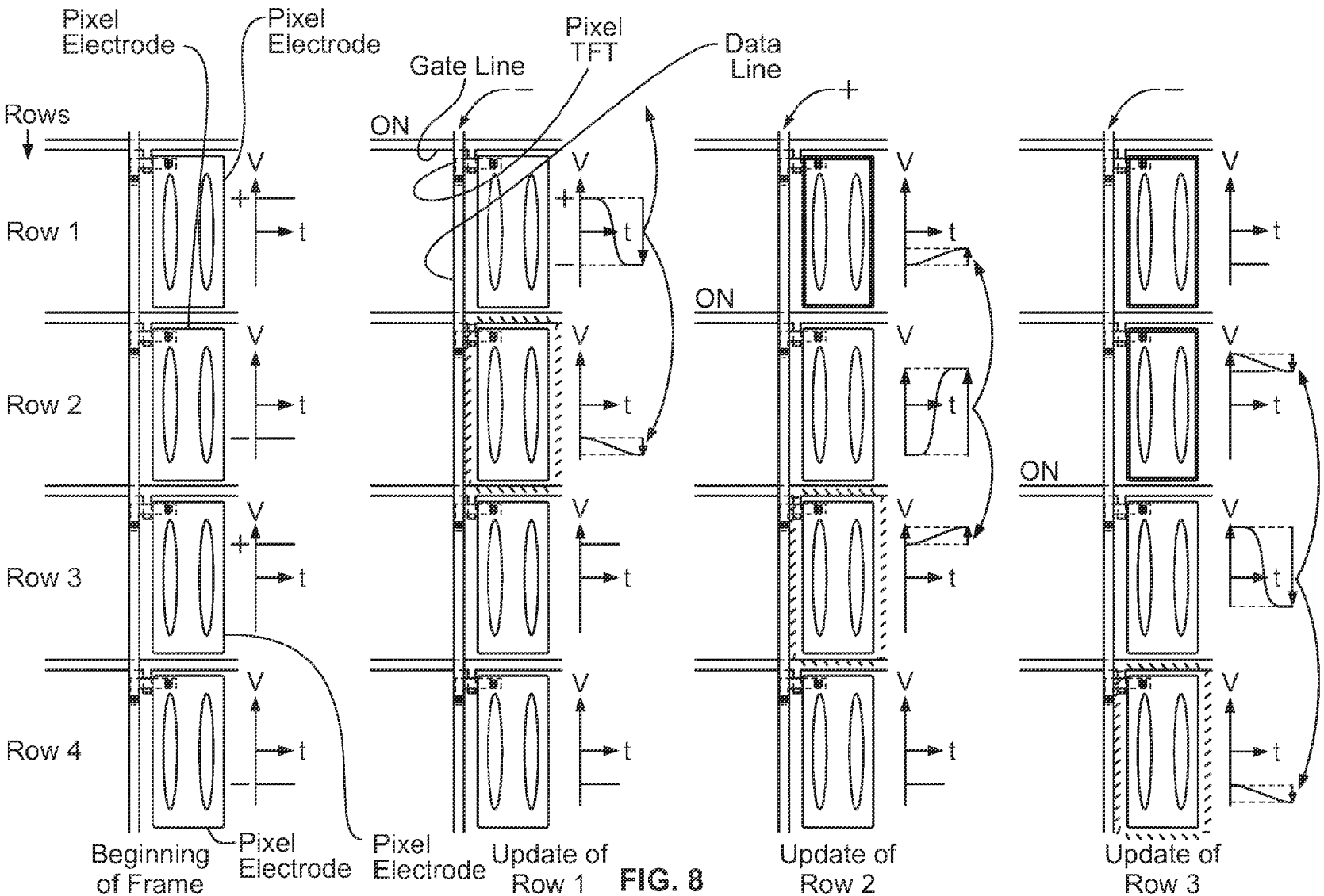
FIG. 8 illustrates an example scanning operation in which rows can be scanned in a line-by-line sequential order according to various embodiments.

FIG. 8 illustrates an example scanning operation in which rows can be scanned in a line-by-line sequential order. The inversion scheme shown in FIG. 8 can be, for example, single line inversion (or single dot inversion). The voltages on pixel electrodes 801*a-d* of four rows 803 are represented by voltage graphs next to each pixel electrode, which show the voltage on the pixel electrode during scanning of various rows. At the beginning of the frame, pixel electrode 801*a* of row 1 can have a positive voltage, pixel electrode 801*b* of row 2 can have a negative voltage, pixel electrode 801*c* of row 3 can have a positive voltage, and pixel electrode 801*d* of row 4 can have a negative voltage. The voltages at the beginning of the frame can be, for example, the target voltages that were applied to the pixels during the previous frame. In other words, the voltages of the pixel electrodes 801*a-d* at the beginning of the frame can be the voltages used to display the image of the previous frame. In this example, the polarity of the voltages on the pixel electrodes 801*a-d* can be changed for each scan line (e.g., single line inversion or single dot inversion). FIG. 8 shows a scan of row 1, during which a pixel TFT 805 of a pixel electrode 801*a* of row 1 can be switched on by applying the appropriate gate line voltage to a gate line 807. During the scan of row 1, a negative voltage can be applied to a data line 809 to update the voltage on the pixel electrode of row 1 as shown in the voltage graph next to the pixel electrode. The voltage graph of pixel electrode 801*a* during the scan of row 1 shows a voltage swing from positive voltage to negative voltage, which is represented in the voltage graph by a large down arrow. Due to effects such as the capacitance coupling described above, for example, the large negative voltage swing of pixel electrode 801*a* can cause a corresponding negative voltage swing in adjacent pixel electrodes such as pixel electrode 801*b*. This effect on the voltages on adjacent pixel electrodes can be significantly smaller in magnitude, therefore, the voltage graph of pixel electrode 801*b* shows a slight negative change, which is represented in the voltage graph by a small down arrow, during the scan of row 1. As described above, the luminance of the sub-pixel associated with a pixel electrode can depend on the magnitude of the pixel voltage. The negative voltage change in pixel electrode 801*b* caused by the large negative voltage swing in pixel electrode 801*a* can increase the magnitude of the voltage of pixel electrode 801*b*. Therefore, the effect of the negative voltage swing on pixel electrode 801*a* can be an increase in the luminance, e.g., brightness, of the sub-pixel of pixel electrode 801*b*. The increase in brightness sub-pixel of pixel electrode 801*b* is represented in FIG. 8 by hatch marks surrounding pixel electrode 801*b*.

In the scan of row 2, pixel TFT 805 of pixel electrode 801*b* can be switched on with a gate line voltage applied to the corresponding gate line 807, while the pixel TFTs of the other rows can remain off. While pixel electrode 801*b* is connected to data line 809 during the scan of row 2, a positive target voltage can be applied to the data line to update the voltage of pixel electrode 801*b*. The voltage graph of pixel electrode 801*b* illustrates that the application of the positive voltage causes a large positive voltage swing on pixel electrode 801*b*, which is represented by the large up arrow in the voltage graph. A large positive swing in voltage on pixel electrode 801*b* can affect the voltages of adjacent pixel electrodes 801*a* and 801*c* correspondingly, resulting in relatively smaller positive changes in voltage on the two adjacent pixel electrodes. The smaller positive voltage swings in the adjacent pixel electrodes are represented in the corresponding voltage graphs by small up arrows. The positive voltage change on pixel electrode 801*a* can cause the negative voltage on the pixel electrode to be reduced in magnitude, which can result in decrease in the brightness of the sub-pixel of pixel electrode 801*a*. In other words, the brightness of the sub-pixel of pixel electrode 801*a* can be reduced such that the sub-pixel appears darker, which is represented in FIG. 8 by the thicker, dark borders shown on pixel electrode 801*a* in the scan of row 2.

The large positive voltage swing on pixel electrode 801*b* can result in an increase in the brightness of the sub-pixel of pixel electrode 801*c* because the positive change to the voltage on pixel electrode 801*c* can increase the magnitude of the voltage on pixel electrode 801*c*. The increase in brightness of pixel electrode 801*c* is represented in FIG. 8 by hatch marks surrounding pixel electrode 801*c*.

In the scan of row 2, the application of the target voltage to pixel electrode 801*b* can correct, or overwrite, the erroneous increase in brightness introduced previously. For example, in the scan of row 1, the brightness of the sub-pixel of pixel electrode 801*b* was increased, making the sub-pixel appear brighter, due to the voltage swing occurring on pixel electrode 801*a*. While this increased brightness of pixel electrode 801*b* might otherwise be visible as a display artifact, in this case, the erroneous increase in brightness can be quickly overwritten in the scan of row 2, which immediately follows the scan of row 1. In other words, in the scan of row 2, the voltage on pixel electrode 801*b* is updated to the target voltage for the sub-pixel regardless of whether the pixel electrode 801*b* is being update from a correct voltage (i.e., the target voltage from the previous frame) or updated from an incorrect voltage (e.g., an erroneously higher or lower voltage). Therefore, pixel electrode 801*b* is shown during the scan of row 2 in FIG. 8 with the hatch marks removed. In other words, the scan of row 2 can overwrite the erroneous voltage on pixel electrode 801*b* with the current target voltage.

During a scan of row 3, pixel TFT 805 corresponding to pixel electrode 801*c* can be switched on, as described above. A negative target voltage can be applied to data line 809, which can cause the voltage on pixel electrode 801*c* to swing from positive to negative as represented by the large down arrow in the voltage graph. The negative swing in voltage on pixel electrode 801*c* can cause negative voltage changes on pixel electrodes 801*b* and 801*d*, causing a decrease in the magnitude of the positive voltage on pixel electrode 801*b* and an increase in magnitude of the voltage on pixel electrode 801*d*. Thus, as before, updating the voltage on pixel electrode 801*c* can affect adjacent sub-pixels by causing the sub-pixel of pixel electrode 801*b* to appear darker and the sub-pixel of pixel electrode 801*d* to appear brighter.

Figure 9:
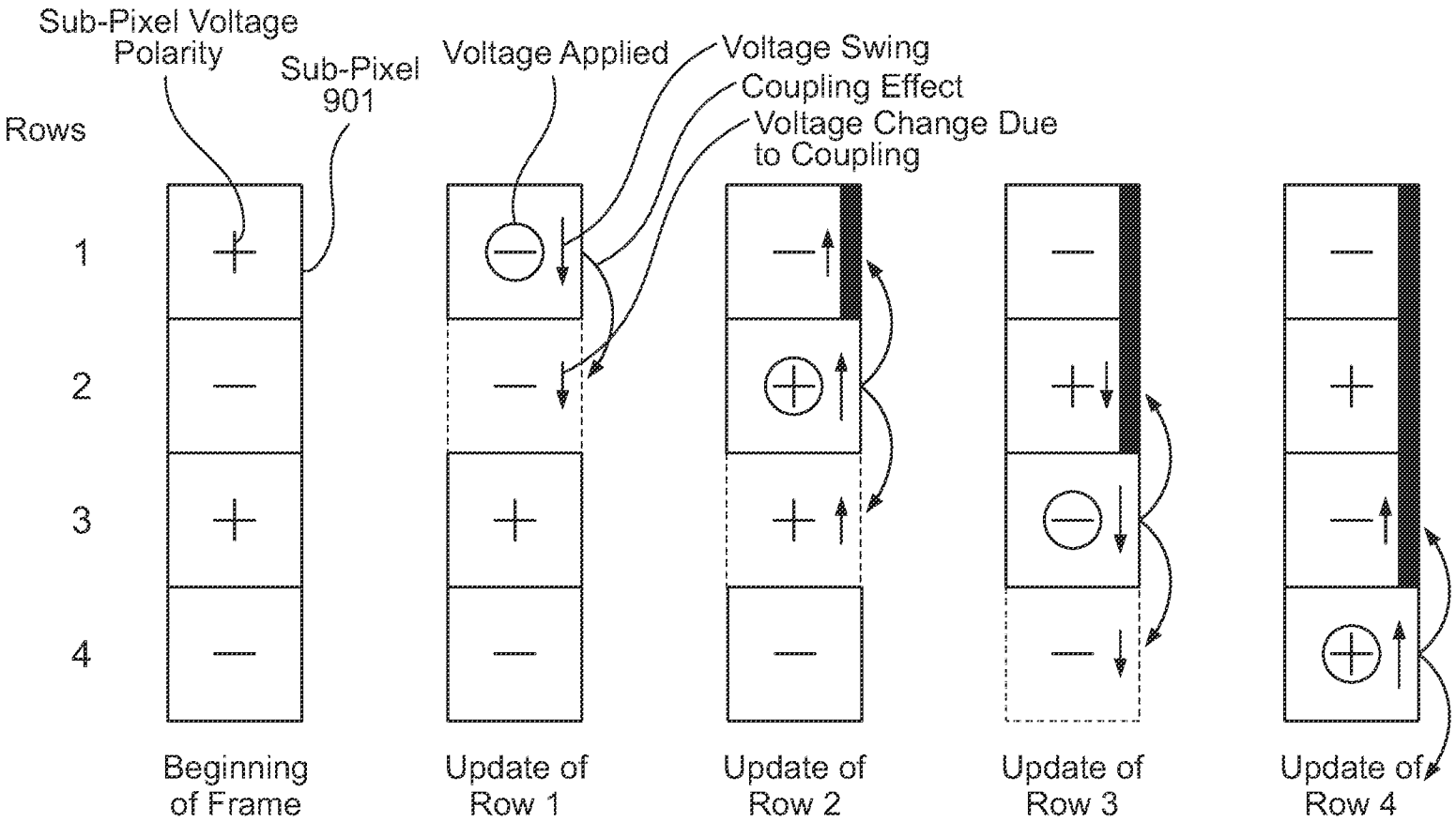
FIG. 9 shows another representation of the example scanning operation shown in FIG. 8.

FIG. 9 shows another representation of the example scanning operation shown in FIG. 8. Specifically, FIG. 9 illustrates a simplified notation for describing various effects on sub-pixel brightness due to pixel-to-pixel capacitive coupling that can occur during scanning operations. The notation illustrated in FIG. 9 will be adopted below in the descriptions of additional example embodiments.

FIG. 9 illustrates rows 803 including sub-pixels 901 corresponding to the sub-pixels of pixel electrodes 801*a-d* of FIG. 8. Sub-pixel voltage polarities associated with each sub-pixel 901 are shown in FIG. 9. The sub-pixel voltage polarities correspond to the polarities of the voltages on pixel electrodes 801*a-d* shown in FIG. 8. FIG. 9 illustrates the voltage polarities on the sub-pixels 901 of rows 1-4 at the beginning of the frame, corresponding to FIG. 8. As described above, during the update of row 1, a target voltage is applied to the pixel electrode (i.e., pixel electrode 801*a*) of sub-pixel 901 in row 1. As in FIG. 6, the direct application of voltage to a pixel electrode is illustrated in the figures with the notation of a circle around the polarity sign of the applied voltage in the sub-pixel. A large voltage swing on a pixel electrode of a sub-pixel due to a direct application of voltage to the pixel electrode is illustrated in the figures with the notation of a large up-arrow, corresponding to a positive voltage swing, or a large down-arrow, corresponding to a negative voltage swing, in the sub-pixel. The large up or down arrow positioned to the right of the sub-pixel polarity sign represents a voltage swing on the corresponding pixel electrode of the sub-pixel (as described above, a large arrow positioned to the left of the sub-pixel polarity sign is be used to represent a voltage swing on the data line corresponding to the sub-pixel). The pixel-to-pixel capacitive coupling effect is represented in FIG. 9 by vertical, curved arrows from the sub-pixel being updated to the sub-pixels in adjacent rows, and the voltage change in an adjacent sub-pixel due to pixel-to-pixel coupling is represented by a small up or down arrow positioned to the right of the voltage polarity sign in the affected sub-pixel.

In the update of row 1 shown in FIG. 9, for example, the negative target voltage applied to sub-pixel 901 of row 1 can cause a negative voltage swing because the sub-pixel voltage polarity of the sub-pixel was positive at the beginning of the update of row 1, e.g., at the beginning of the frame. As described above, the negative voltage swing can cause a corresponding negative voltage change on sub-pixel 901 of row 2, which is illustrated in the figures with the notation of a small down-arrow positioned to the right of the voltage polarity sign of sub-pixel 901 of row 2. Also as described above, the negative voltage change can cause sub-pixel 901 of row 2 to appear brighter, which is illustrated in the figures with the notation of a dashed-lined right-hand border of the sub-pixel.

In the update of row 2 shown in FIG. 9, a positive polarity target voltage can be applied to sub-pixel 901 of row 2, which can cause a large positive voltage swing on the sub-pixel. As described above, sub-pixel 901 of row 1 can be affected by becoming darker due to the corresponding positive voltage change to the negative polarity voltage on the sub-pixel of row 1. The decrease in brightness, e.g., darker appearance, of sub-pixel 901 of row 1 is illustrated in the figures with the notation of thick, dark right-hand border of the sub-pixel. As described above, sub-pixel 901 of row 3 can appear brighter due to the positive voltage change caused by the voltage swing on the pixel electrode (i.e., pixel electrode 801*b*) of sub-pixel 901 of row 2. Thus, the right-hand border of sub-pixel 901 of row 3 is shown as a dashed line in FIG. 9. The update of row 3 shown in FIG. 9 likewise represents the above-described update of row 3, including the application of negative polarity target voltage to sub-pixel 901 of row 3, a large negative swing on the corresponding pixel electrode, and a resulting decrease and increase in the brightness of the sub-pixels of row 2 and row 4, respectively.

FIG. 9 also illustrates the update of row 4, in which the change in polarity of sub-pixel 901 of row 4 can result in a decrease in the brightness of the preceding sub-pixel of row 3, and an increase in the brightness of the next sub-pixel of row 5 (not shown). Thus, it can be seen from FIG. 9 that the scanning of each row under the particular inversion scheme of the present example, i.e., single line inversion (or single dot inversion), can result in a decrease in brightness of the sub-pixels in preceding rows and an increase in brightness of the sub-pixels in the next rows. However, the increase in brightness of the next row can be subsequently overwritten in the next scan step, leaving only the decreases in brightness of each sub-pixel of the display.

Having individually described data-to-data capacitive coupling effects and pixel-to-pixel capacitive coupling effects above, the combined effects of data-to-data and pixel-to-pixel capacitive coupling will now be described in reference to FIGS. 10-16. The simplified notation described above with respect to FIGS. 6 and 9 will be used in FIGS. 10-16 to illustrate the various capacitive coupling effects that can occur during an example scanning operation of a display screen 1000 using a 2-line inversion scheme, such as described above in reference to FIG. 2B, in combination with a scanning order of updating rows sequentially in order of row position.

Figure 16:
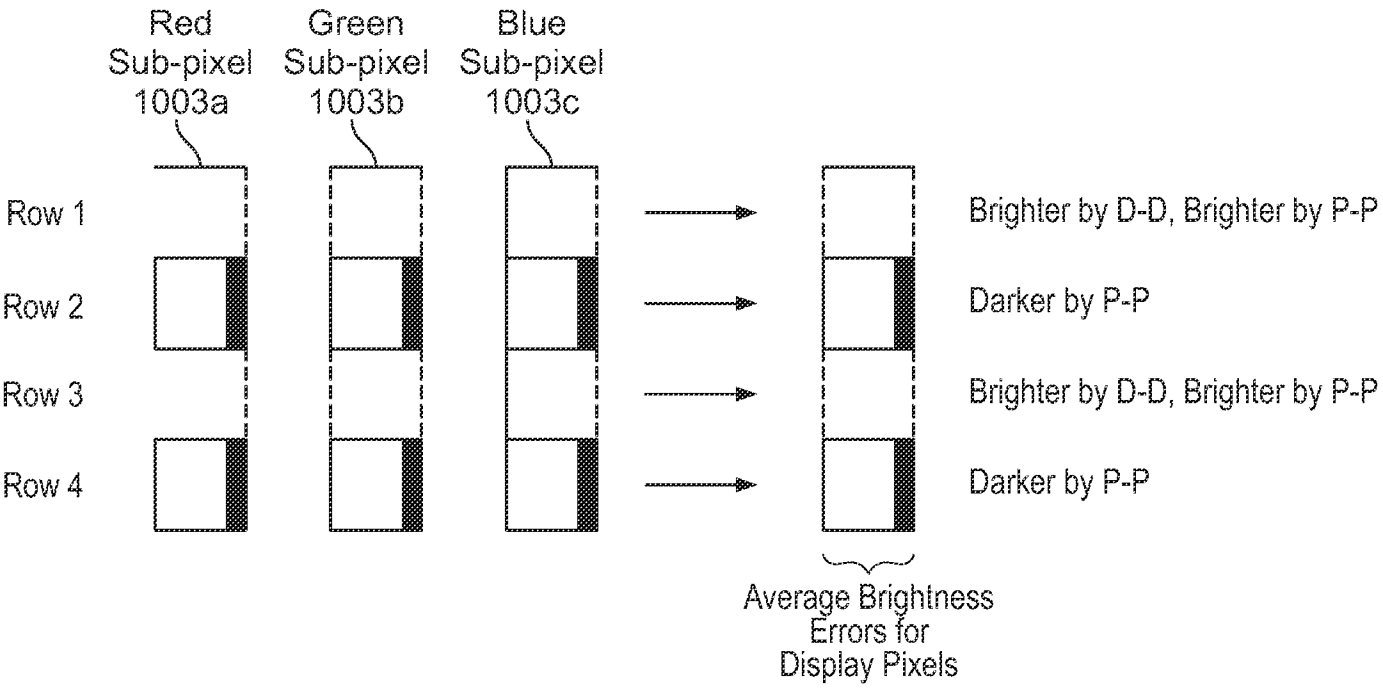
FIG. 16 illustrates errors in brightness that can result from two types of capacitive coupling effects according to various embodiments.

FIGS. 10-15 illustrate an example 2-line inversion scanning operation of display screen 1000 by showing details of the applications of data voltages to a single display pixel 1001 in each of rows 4-9 of the display screen. Each display pixel 1001 can include a red sub-pixel 1003*a*, a green sub-pixel 1003*b*, and a blue sub-pixel 1003*c*. FIG. 16 illustrates errors in brightness in individual sub-pixels of the display pixels that can result from data-to-data capacitive coupling effects and pixel-to-pixel capacitive coupling effects. FIG. 16 also illustrates an average error in brightness in each display pixel that can result from an average of the sub-pixel errors of the display pixel.

Figure 10:
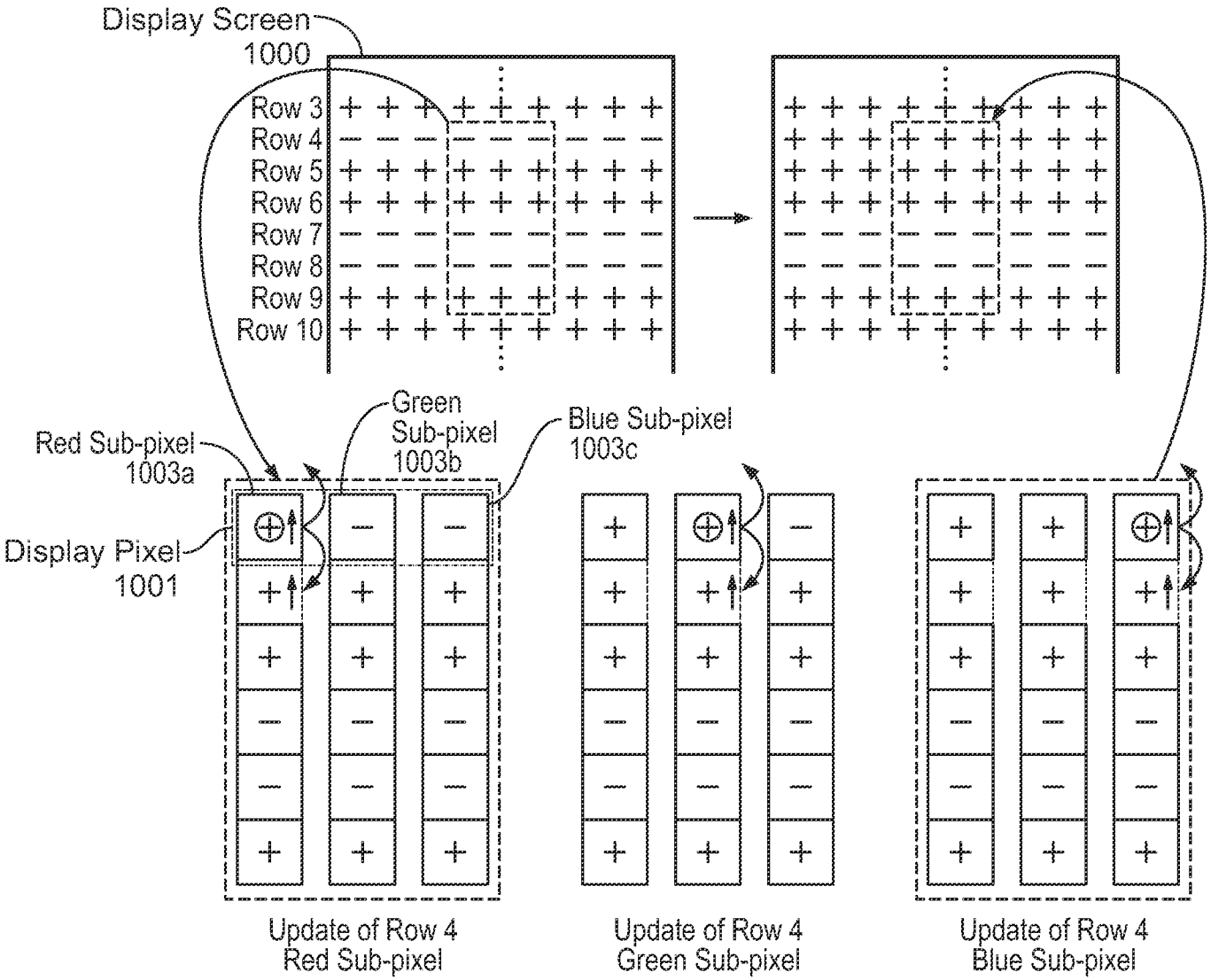
FIGS. 10-15 illustrate a detailed example of a scanning operation using a combination of a 2-line inversion scanning operation of a display screen and a scanning order of updating rows sequentially in order of row position.

The following description begins with the updating of row 4 of display screen 1000, shown in FIG. 10. However, it is understood the updating of rows 1-3, which is not shown in detail, can occur before the updating of row 4 begins. In this regard, it is noted that row 3 (shown in the figure as a row of positive polarities) can be updated with the positive data voltages immediately prior to the update of row 4.

In the example scanning operation, an RGB write sequence can be used. Accordingly, the update of display pixel 1001 of row 4 can begin with the update of the red sub-pixel. The row 4 red sub-pixel can be updated by applying a positive data voltage to the corresponding red data line, which can result in no large voltage swing on the red data line because the previous voltage on the red data line can also be positive polarity (due to the application of positive voltage during the update of row 3). Therefore, the update of the row 4 red sub-pixel can result in no data-to-data coupling effects (accordingly, there is no large up/down arrow shown to the left of the row 4 red sub-pixel polarity).

However, the update of the row 4 red sub-pixel can result in pixel-to-pixel coupling effects because the voltage on the pixel electrode of the row 4 red sub-pixel can be a negative polarity voltage (applied during the scanning of the previous frame). Therefore, a large up-arrow is shown to the right of the voltage polarity of the red sub-pixel. The pixel-to-pixel coupling effect of the positive voltage swing can increase the brightness of the row 5 red sub-pixel. Likewise, the updates of the row 4 green and blue sub-pixels can result in increases in the brightnesses of the row 5 green and blue sub-pixels, respectively, due to pixel-to-pixel coupling effects.

FIG. 10 illustrates the voltage polarity pattern of display screen 1000 before the update of row 4 (when the voltage polarities of row 4 are "−") and after the update of row 4 (when the voltage polarities of row 4 are "+").

Figure 11:
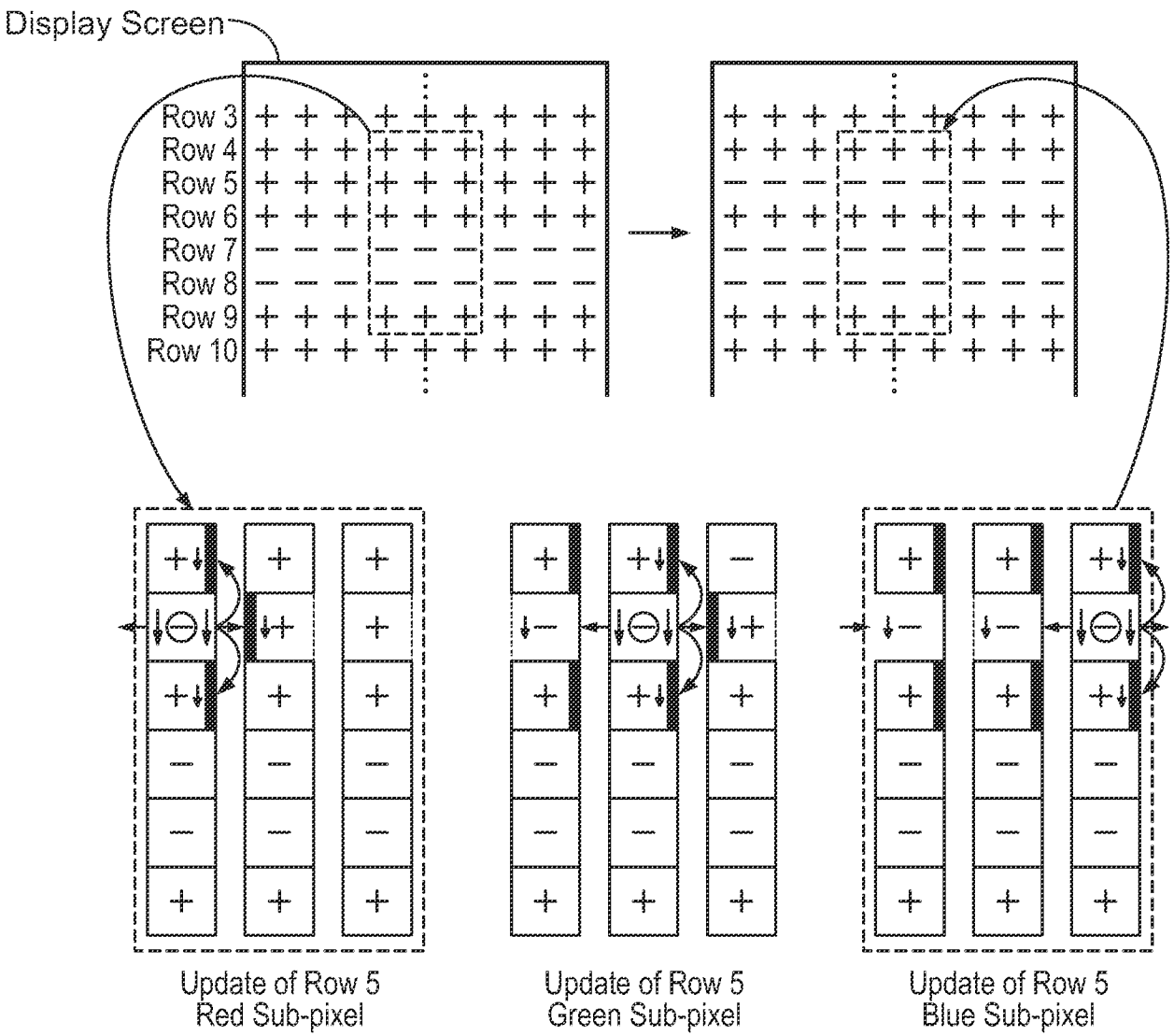
Figure 12:
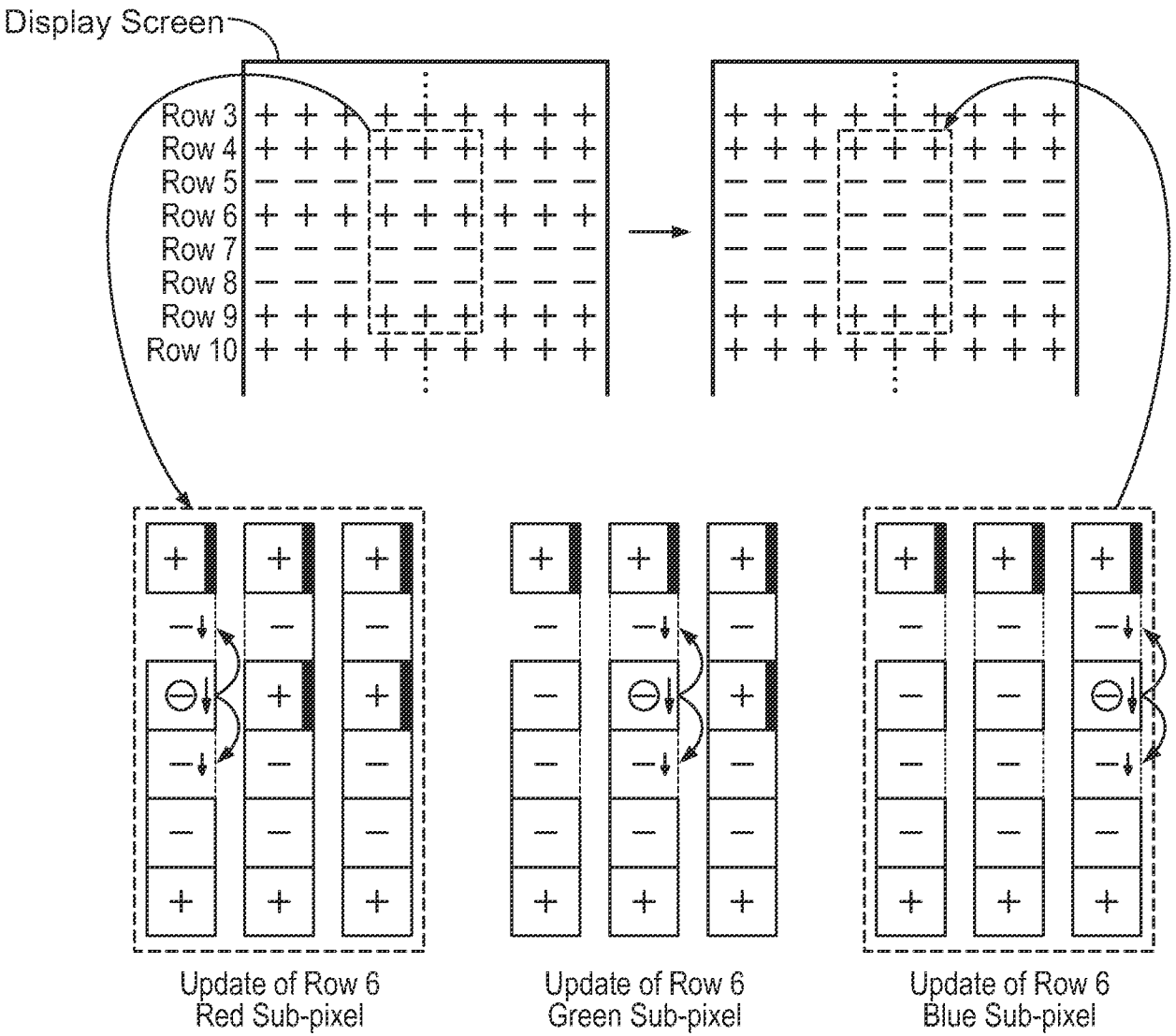
Figure 13:
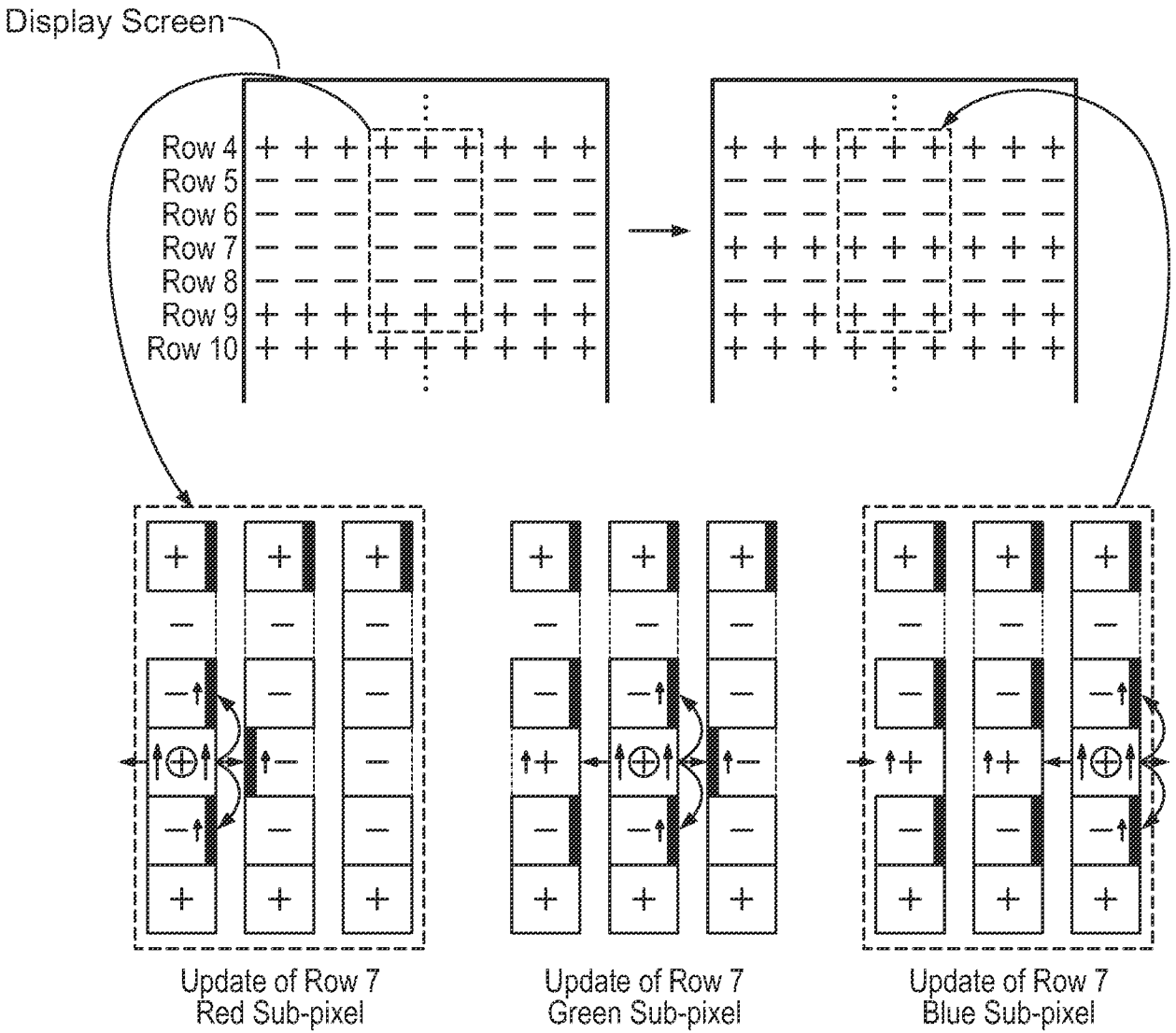
Figure 14:
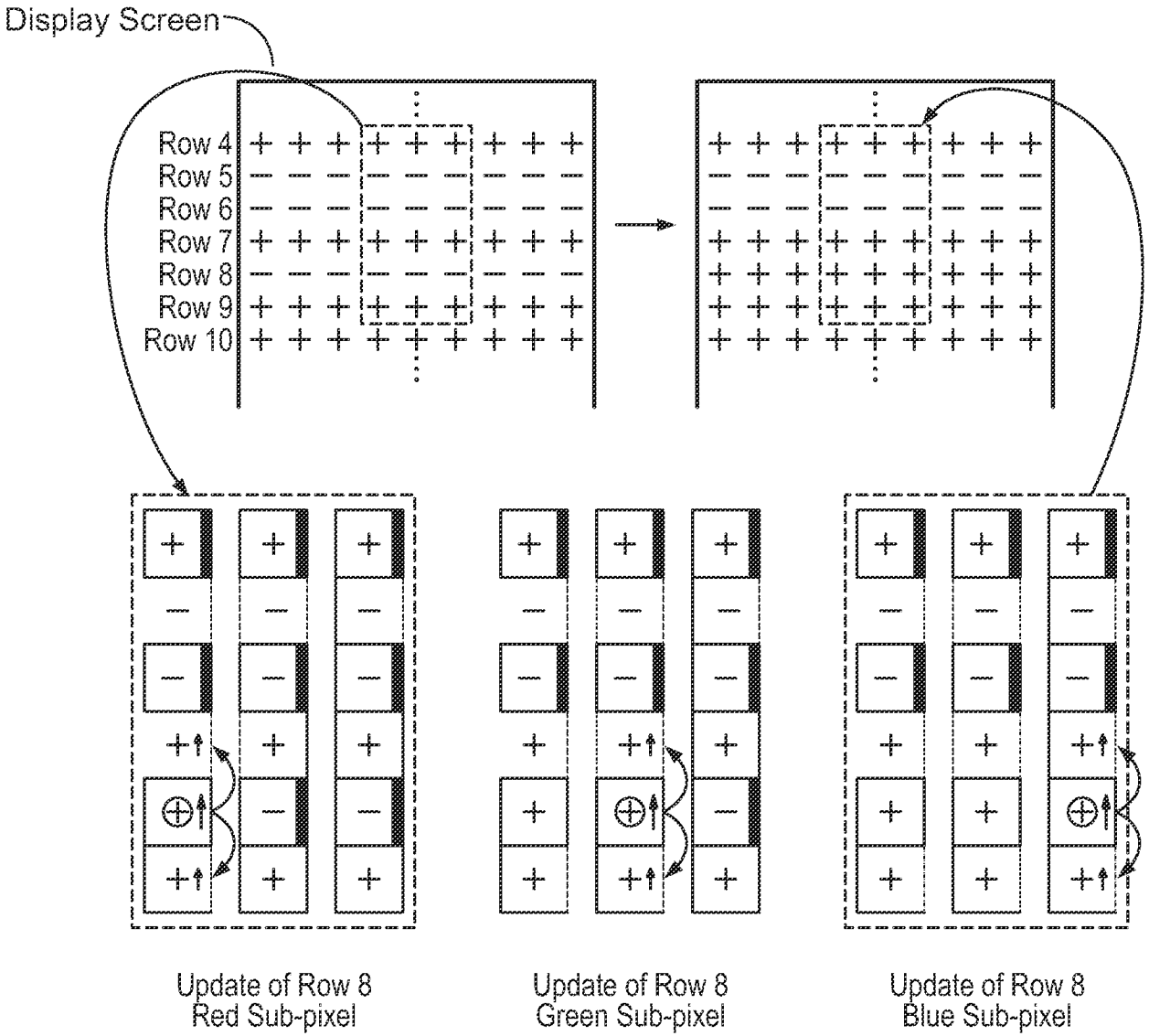
Figure 15:
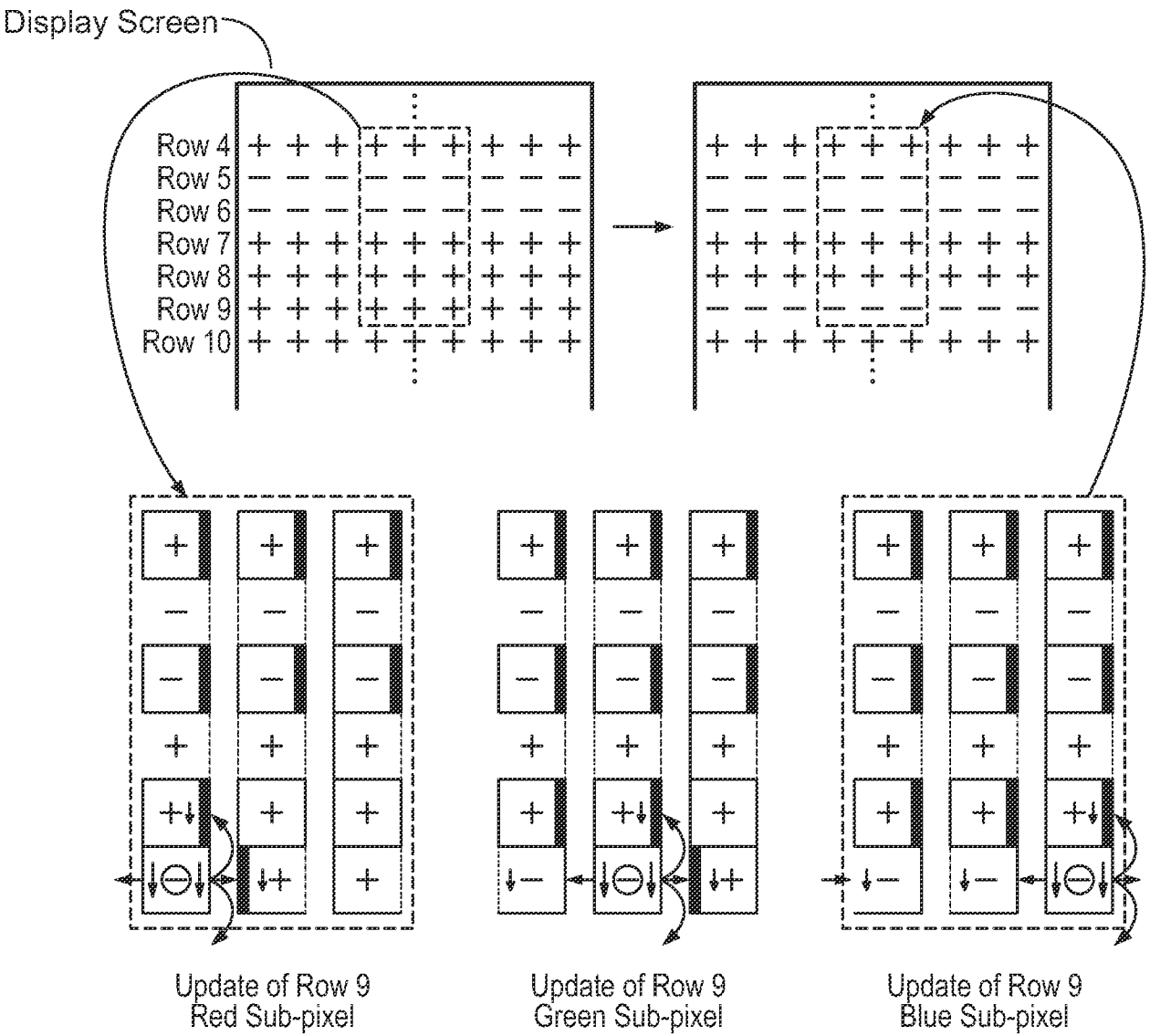

FIG. 11 illustrates the update of row 5, which can change the voltage polarities of the sub-pixels of row 5 from "−" to "+". A negative data voltage can be applied to the red data line during the update of row 5 red sub-pixel. Because the previous voltage on the red data line was positive (from the update of row 4), the application of positive data voltage can cause a large negative voltage swing on the red data line, which can result in data-to-data coupling effects as illustrated by the horizontal arrows from the row 5 red sub-pixel to the adjacent green sub-pixel in display pixel 1001 and the adjacent blue sub-pixel (not shown) in a display pixel adjacent to display pixel 1001. The data-to-data coupling effect can cause a decrease in the brightness of the row 5 green sub-pixel, which is represented in FIG. 11 by the thick, dark left-hand border of the green sub-pixel. The update of the row 5 red sub-pixel can also result in pixel-to-pixel coupling effects that can decrease the brightnesses of adjacent red sub-pixels in rows 4 and 6.

The update of the row 5 green sub-pixel can similarly result in data-to-data coupling effects in the row 5 red and blue sub-pixels, and can result in pixel-to-pixel coupling effects in the row 4 and row 6 green sub-pixels, as shown in the figure. Likewise, the update of the row 5 blue sub-pixel can result in data-to-data and pixel-to-pixel coupling effects in adjacent sub-pixels, as shown in the figure.

FIGS. 12, 13, 14, and 15 describe the updates of rows 6, 7, 8, and 9, respectively, showing the applications of data voltages in accordance with the example 2-line inversion scheme and the various resulting data-to-data and pixel-to-pixel coupling effects using the foregoing notation. After the update of the row 9 blue sub-pixel, shown in FIG. 15, the scanning of the remaining rows of display screen 1000 can result in no further changes in the brightnesses of the sub-pixels in rows 5-8. In other words, after the update of row 9, the errors in brightness of rows 5-8 can remain unchanged and persist until the next frame update, which can result in visual artifacts.

FIG. 16 summarizes the errors in brightness in individual sub-pixels of display pixels 1001 of rows 5-8 that can result from data-to-data capacitive coupling effects and pixel-to-pixel capacitive coupling effects in the example 2-line inversion scheme scanning order. FIG. 16 also illustrates an average error in brightness in each display pixel that can result from an average of the sub-pixel errors of the display pixel.

In display pixel 1001 of row 5, data-to-data coupling errors in the individual sub-pixels can include a twice increased brightness in red sub-pixel 1003*a*, an increased brightness in green sub-pixel 1003*b*, and no increase in the brightness of blue sub-pixel 1003*c*. An average brightness error resulting from data-to-data coupling effects in the row 5 display pixel 1001 can be a single data-to-data (D-D) brightness increase, which is illustrated by the dashed-line left-hand border of the row 5 display pixel in the "Average Brightness Error for Display Pixels" column in FIG. 16. In some embodiments, data-to-data coupling errors can be distributed among different colored sub-pixels by, for example, using different writing sequences for writing data into the sub-pixels of different display pixels. For example, some display pixels can be updated with an RGB writing sequence, while other display pixels can be updated with a BGR writing sequence.

The pixel-to-pixel coupling errors in the individual sub-pixels of the row 5 display pixel 1001 can include an increased brightness in each of red sub-pixel 1003*a*, green sub-pixel 1003*b*, and blue sub-pixel 1003*c*. Thus, an average brightness error resulting from pixel-to-pixel coupling effects in the row 5 display pixel 1001 can be a single pixel-to-pixel (P-P) brightness increase, which is illustrated by the dashed-line right-hand border of the row 5 display pixel in the "Average Brightness Error" column.

In display pixel 1001 of row 6, data-to-data coupling errors in the individual sub-pixels can include no increase in the brightness of any of the red, green, or blue sub-pixels. Thus, display pixel 1001 of row 6 can have no average D-D brightness errors. The pixel-to-pixel coupling errors in the individual sub-pixels of the row 6 display pixel 1001 can include a increased brightness in each of red sub-pixel 1003*a*, green sub-pixel 1003*b*, and blue sub-pixel 1003*c*. Thus, an average brightness error resulting from pixel-to-pixel coupling effects in the row 6 display pixel 1001 can be a single pixel-to-pixel (P-P) brightness decrease, which is illustrated by the thick, dark right-hand border of the row 6 display pixel in the "Average Brightness Error" column.

The brightness errors in the row 7 display pixel can be the same as the brightness errors in the row 5 display pixel, and the brightness errors in the row 8 display pixel can be the same as the brightness errors in the row 6 display pixel. In other words, a pattern of brightness errors can repeat every two rows. Thus, in this example scanning operation, using a particular scanning order (i.e., updating the rows sequentially by row position starting at row 1 and ending with the last row) and a particular inversion scheme (i.e., 2-line inversion), a pattern of D-D and P-P brightness errors shown in FIG. 16 can result.

Using other scanning orders and other inversion scheme can result in other patterns of D-D and P-P brightness errors. In some cases, the particular scanning order and inversion scheme combination, and the resulting pattern of D-D and P-P brightness errors, can be considered in designing a display screen such that the D-D errors and P-P errors can be made to substantially offset each other. In some embodiments, offsetting the errors can be accomplished by causing the particular combination of D-D and P-P brightness errors to result in a substantially uniform increase or decrease in the brightness of most or all of the sub-pixels. A uniform increase or decrease in brightness can have no visual artifacts because there can be no significant differences in brightness that could be perceived by a user. In some embodiments, offsetting the errors can be accomplished by causing the particular combination of D-D brightness errors and P-P brightness errors to cancel each other. For example, in some embodiments display screen design criteria can result in a magnitude of a D-D brightness increase in a sub-pixel to be approximately equal to a magnitude of a P-P brightness decrease in the sub-pixel. The this way, for example, a particular design criteria can be used to cancel brightness increases with brightness decreases, or vice versa.

Example embodiments of particular scanning order and inversion scheme combinations, together with display screen design criteria that can reduce or eliminate visual artifacts by offsetting D-D and P-P brightness errors, will now be described with reference to FIGS. 17 and 18. The detailed example analysis described above can be applied to each of the following example combinations of scanning order and inversion scheme. Therefore, a detailed analysis of each step in the scanning process will not be described for the example embodiments described below, as one skilled in the art would readily understand how the resulting patterns of D-D and P-P brightness errors can occur in light of the foregoing detailed example description.

Figure 17:
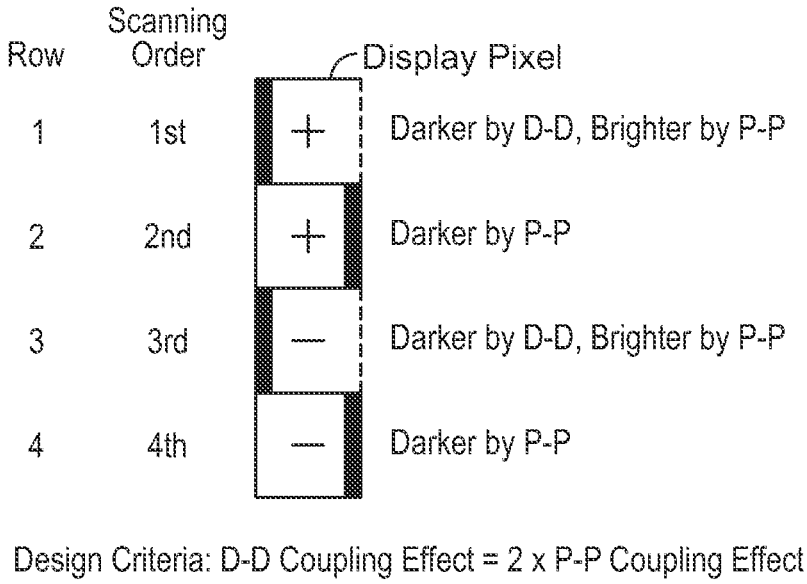
FIG. 17 illustrates an example D-D and P-P brightness error pattern for a scanning process using a 2-dot inversion scheme in combination with a scanning order of updating rows sequentially in order of row position according to various embodiments.

FIG. 17 illustrates an example D-D and P-P brightness error pattern for a scanning process using a 2-dot inversion scheme, such as the inversion scheme shown in FIG. 3B in combination with a scanning order of updating rows sequentially in order of row position. Average D-D brightness errors in a row 1 display pixel and a row 2 display pixel can be a decrease in brightness and no error, respectively. Average P-P brightness errors in a row 1 display pixel and a row 2 display pixel can be an increase in brightness and a decrease in brightness, respectively. This pattern of D-D and P-P brightness errors can repeat in rows 3 and 4, etc.

In this example, designing the display screen such that the D-D coupling results in twice (or approximately twice) the brightness error effect (i.e., increase/decrease) of the P-P coupling can result in a uniform decrease in brightness in the sub-pixels. For example, in the display pixel of row 1, a D-D coupling brightness decrease that is twice the P-P coupling brightness increase can result in an overall brightness decrease of approximately the magnitude of a single P-P coupling brightness decrease. Because the row 2 display pixel can include only a single P-P coupling brightness decrease, the brightness errors in the display pixels of rows 1 and 2 (and likewise, all of the remaining display pixels) can be uniform. In this way, for example, the particular display screen design criteria of designing the D-D coupling effect to be twice the P-P coupling effect can reduce or eliminate visual artifacts in the particular combination of a 2-dot inversion scheme and a scanning order of updating rows sequentially by row position.

For display screens in which a change in voltage of an aggressor data line is the same as the change in voltage of an aggressor pixel electrode (e.g., the aggressor data line is electrically connected to the aggressor pixel electrode), and using equations (1) and (2) above, the design criteria can be summarized as the DtoD_cap_ratio should be twice the PtoP_cap_ratio. Designing to this criteria may involve, for example, adjusting distances between pixel electrodes, adding protruding features, changing dielectric thicknesses of structures, changing pixel electrode area, height, etc.

Figure 18:
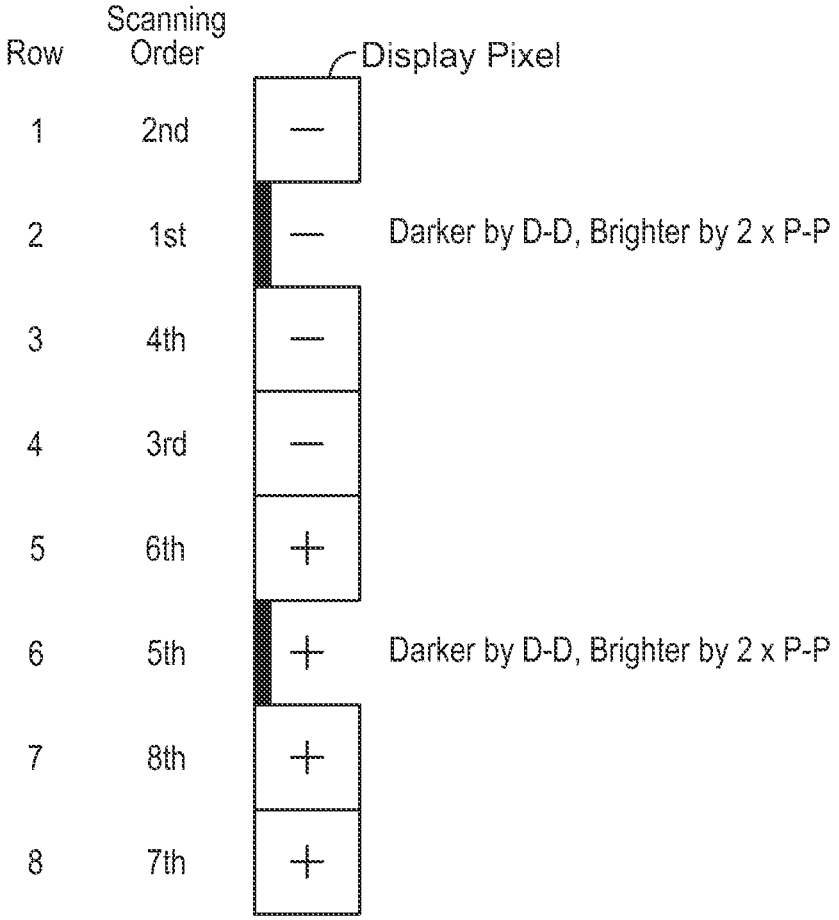
FIG. 18 illustrates an example D-D and P-P brightness error pattern for a scanning process using a 4-dot inversion scheme in combination with a reordered scanning order according to various embodiments.

FIG. 18 illustrates an example D-D and P-P brightness error pattern for a scanning process using a 4-dot inversion scheme, such as the inversion scheme shown in FIG. 3C in combination with a scanning order of updating rows in the following order: row 2, row 1, row 4, row 3, row 6, row 5, row 8, row 7. In this particular combination of inversion scheme and scanning order, there can be no resulting D-D and P-P brightness errors in display pixels in rows 1, 3-5, 7, and 8. In each of a row 2 display pixel and a row 6 display pixel, there can be a decrease in brightness caused by D-D coupling and a twice increase in brightness caused by P-P coupling. This pattern of D-D and P-P brightness errors can repeat in the remaining blocks of eight rows in the display screen.

In this example, designing the display screen such that the D-D coupling results in twice the brightness error effect (i.e., increase/decrease) of the P-P coupling can allow the D-D coupling decrease in brightness and the P-P increases in brightness to cancel each other. In this way, for example, the particular display screen design criteria of designing the D-D coupling effect to be twice (or approximately twice) the P-P coupling effect can reduce or eliminate visual artifacts in the particular combination of a 4-dot inversion scheme and a scanning order of updating the rows in each block of eight rows in the order of rows 2, 1, 4, 3, 6, 5, 8, and 7.

As in the previous example embodiment, for display screens in which a change in voltage of an aggressor data line is the same as the change in voltage of an aggressor pixel electrode (e.g., the aggressor data line is electrically connected to the aggressor pixel electrode), and using equations (1) and (2) above, the design criteria can be summarized as the DtoD_cap_ratio should be twice the PtoP_cap_ratio. Designing to this criteria may involve, for example, adjusting distances between pixel electrodes, adding protruding features, changing dielectric thicknesses of structures, changing pixel electrode area, height, etc.

Although embodiments of this disclosure have been fully described with reference to the accompanying drawings, it is to be noted that various changes and modifications including, but not limited to, combining features of different embodiments, omitting a feature or features, etc., as will be apparent to those skilled in the art in light of the present description and figures.

For example, one or more of the functions of scanning a display screen using a particular combination of inversion scheme and scanning order described above can be performed by computer-executable instructions, such as software/firmware, residing in a medium, such as a memory, that can be executed by a processor, as one skilled in the art would understand. The software/firmware can be stored and/or transported within any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "non-transitory computer-readable storage medium" can be any physical medium that can contain or store the program for use by or in connection with the instruction execution system, apparatus, or device. The non-transitory computer-readable storage medium can include, but is not limited to, an electronic, magnetic, optical, electromagnetic, infrared, or semiconductor system, apparatus or device, a portable computer diskette (magnetic), a random access memory (RAM) (magnetic), a read-only memory (ROM) (magnetic), an erasable programmable read-only memory (EPROM) (magnetic), a portable optical disc such a CD, CD-R, CD-RW, DVD, DVD-R, or DVD-RW, or flash memory such as compact flash cards, secured digital cards, USB memory devices, memory sticks, and the like. In the context of this document, a "non-transitory computer-readable storage medium" does not include signals. In contrast, in the context of this document, a "computer-readable medium" can include all of the media described above, and can also include signals.

Figure 19:
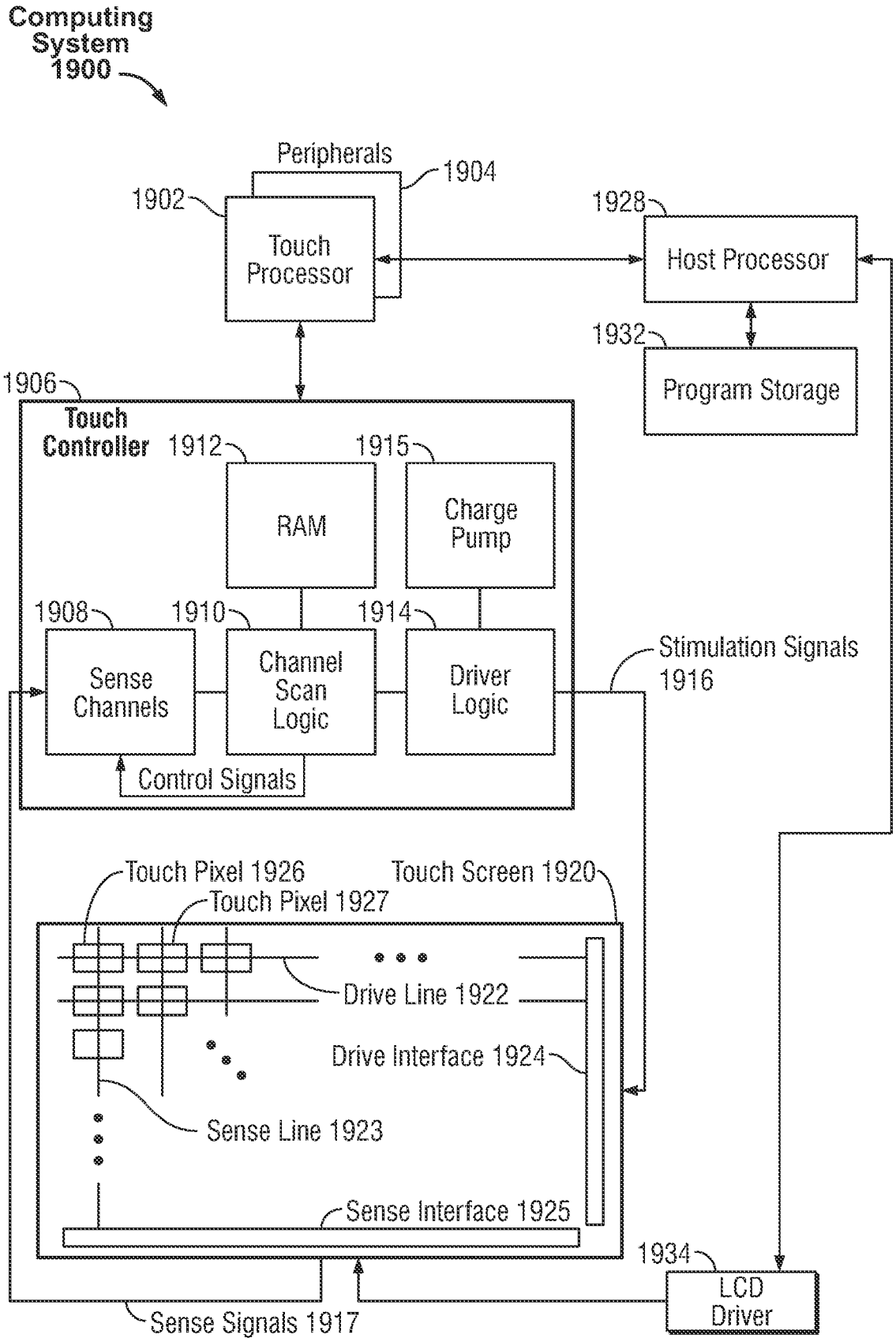
FIG. 19 is a block diagram of an example computing system that illustrates one implementation of an example scanning system of a display screen according to embodiments of the disclosure.

FIG. 19 is a block diagram of an example computing system 1900 that illustrates one implementation of an example scanning system of a display screen according to embodiments of the disclosure. In the example of FIG. 19, the computing system is a touch sensing system 1900 and the display screen is a touch screen 1920, although it should be understood that the touch sensing system is merely one example of a computing system, and that the touch screen is merely one example of a type of display screen. Computing system 1900 could be included in, for example, mobile telephone 136, digital media player 140, personal computer 144, or any mobile or non-mobile computing device that includes a touch screen. Computing system 1900 can include a touch sensing system including one or more touch processors 1902, peripherals 1904, a touch controller 1906, and touch sensing circuitry (described in more detail below). Peripherals 1904 can include, but are not limited to, random access memory (RAM) or other types of memory or non-transitory computer-readable storage media capable of storing program instructions executable by the touch processor 1902, watchdog timers and the like. Touch controller 1906 can include, but is not limited to, one or more sense channels 1908, channel scan logic 1910 and driver logic 1914. Channel scan logic 1910 can access RAM 1912, autonomously read data from the sense channels and provide control for the sense channels. In addition, channel scan logic 1910 can control driver logic 1914 to generate stimulation signals 1916 at various frequencies and phases that can be selectively applied to drive regions of the touch sensing circuitry of touch screen 1920. In some embodiments, touch controller 1906, touch processor 1902 and peripherals 1904 can be integrated into a single application specific integrated circuit (ASIC). A processor, such as touch processor 1902, executing instructions stored in non-transitory computer-readable storage media found in peripherals 1904 or RAM 1912, can control touch sensing and processing, for example.

Computing system 1900 can also include a host processor 1928 for receiving outputs from touch processor 1902 and performing actions based on the outputs. For example, host processor 1928 can be connected to program storage 1932 and a display controller, such as an LCD driver 1934. Host processor 1928 can use LCD driver 1934 to generate an image on touch screen 1920, such as an image of a user interface (UI), by executing instructions stored in non-transitory computer-readable storage media found in program storage 1932, for example, to scan lines (e.g., rows) of sub-pixels of touch screen 1920 by applying voltages to pixel electrodes of adjacent sub-pixels in different lines such that polarity changes in opposite directions can occur in two sub-pixels that are adjacent to a particular sub-pixel. In other words, host processor 1928 and LCD driver 1934 can operate as a scanning system in accordance with the foregoing example embodiments. In some embodiments the touch processor 1902, touch controller 1906, or host processor 1928 may independently or cooperatively operate as a scanning system in accordance with the foregoing example embodiments. Host processor 1928 can use touch processor 1902 and touch controller 1906 to detect and process a touch on or near touch screen 1920, such a touch input to the displayed UI. The touch input can be used by computer programs stored in program storage 1932 to perform actions that can include, but are not limited to, moving an object such as a cursor or pointer, scrolling or panning, adjusting control settings, opening a file or document, viewing a menu, making a selection, executing instructions, operating a peripheral device connected to the host device, answering a telephone call, placing a telephone call, terminating a telephone call, changing the volume or audio settings, storing information related to telephone communications such as addresses, frequently dialed numbers, received calls, missed calls, logging onto a computer or a computer network, permitting authorized individuals access to restricted areas of the computer or computer network, loading a user profile associated with a user's preferred arrangement of the computer desktop, permitting access to web content, launching a particular program, encrypting or decoding a message, and/or the like. Host processor 1928 can also perform additional functions that may not be related to touch processing.

Touch screen 1920 can include touch sensing circuitry that can include a capacitive sensing medium having a plurality of drive lines 1922 and a plurality of sense lines 1923. It should be noted that the term "lines" is sometimes used herein to mean simply conductive pathways, as one skilled in the art will readily understand, and is not limited to elements that are strictly linear, but includes pathways that change direction, and includes pathways of different size, shape, materials, etc. Drive lines 1922 can be driven by stimulation signals 1916 from driver logic 1914 through a drive interface 1924, and resulting sense signals 1917 generated in sense lines 1923 can be transmitted through a sense interface 1925 to sense channels 1908 (also referred to as an event detection and demodulation circuit) in touch controller 1906. In this way, drive lines and sense lines can be part of the touch sensing circuitry that can interact to form capacitive sensing nodes, which can be thought of as touch picture elements (touch pixels), such as touch pixels 1926 and 1927. This way of understanding can be particularly useful when touch screen 1920 is viewed as capturing an "image" of touch. In other words, after touch controller 1906 has determined whether a touch has been detected at each touch pixel in the touch screen, the pattern of touch pixels in the touch screen at which a touch occurred can be thought of as an "image" of touch (e.g. a pattern of fingers touching the touch screen).

In some example embodiments, touch screen 1920 can be an integrated touch screen in which touch sensing circuit elements of the touch sensing system can be integrated into the display pixels stackups of a display.

Although various embodiments are described with respect to display pixels, one skilled in the art would understand that the term display pixels can be used interchangeably with the term display sub-pixels in embodiments in which display pixels are divided into sub-pixels. For example, some embodiments directed to RGB displays can include display pixels divided into red, green, and blue sub-pixels. One skilled in the art would understand that other types of display screen could be used. For example, in some embodiments, a sub-pixel may be based on other colors of light or other wavelengths of electromagnetic radiation (e.g., infrared) or may be based on a monochromatic configuration, in which each structure shown in the figures as a sub-pixel can be a pixel of a single color.

What is claimed is:

1. A display screen comprising:

a plurality of scanning lines, each scanning line including a plurality of display pixels, each display pixel including a plurality of sub-pixels, each sub-pixel including a pixel electrode, the scanning lines arranged such that a pixel-to-pixel capacitance exists between adjacent ones of the pixel electrodes in scanning lines, each pixel-to-pixel capacitance having a predetermined first capacitance value;

a plurality of data lines arranged such that a data-to-data capacitance exists between adjacent ones of the data lines, each data-to-data capacitance having a predetermined second capacitance value;

a scanning system that scans the scanning lines to update data voltages on the pixel electrodes in a scanning order of the scanning lines, the updating of the pixel electrodes in each scanning line including electrically connecting the pixel electrodes in each of the display pixels in the scanning line to a corresponding set of the data lines, applying a target data voltage to each data line in each of the sets of data lines in a predetermined sequence while the data lines corresponding to the other of the data lines in each set of the data lines are electrically floating, wherein a polarity of each of the target data voltages is determined by the scanning system according to a predetermined inversion scheme, wherein each application of target data voltage in a plurality of the applications of target data voltages results in a first error in a brightness of one or more sub-pixels based on a coupling of the corresponding application of target data voltage through one of the pixel-to-pixel capacitances, the first error being based on one of an increase in a magnitude of a voltage on the corresponding pixel electrode and a decrease in the magnitude of the voltage on the corresponding pixel electrode, the increase or decrease being based on the first capacitance value, wherein each application of target data voltage in a plurality of the applications of target data voltages results in a second error in a brightness of one or more sub-pixels based on a coupling of the corresponding application of target data voltage through one of the data-to-data capacitances, the second error being based on one of an increase in a magnitude of a voltage on the corresponding pixel electrode and a decrease in the magnitude of the voltage on the corresponding pixel electrode, the increase or decrease being based on the second capacitance value, wherein the first and second errors offset each other in one or more of the sub-pixels.

2. The display screen of claim 1, wherein the offset of the first and second errors includes one of a cancellation of the first and second errors in a single sub-pixel, a uniform increase in brightness of a plurality of the sub-pixels, and a uniform decrease in brightness of a plurality of the sub-pixels.

3. The display screen of claim 1, wherein the lines of display pixels are arranged in rows.

4. The display screen of claim 1, wherein the inversion scheme includes a 2-dot inversion scheme, the scanning order includes a scanning order of updating scanning lines sequentially in order of scanning line position.

5. The display screen of claim 4, wherein first capacitance value is a first capacitance ratio of a first mutual capacitance and a first self-capacitance, the second capacitance value is a second capacitance ratio of a second mutual capacitance and a second self-capacitance, and the second capacitance ratio is approximately twice the first capacitance ratio.

6. The display screen of claim 1, wherein the inversion scheme includes a 4-dot inversion scheme, the scanning order includes a scanning order of updating scanning lines of a plurality of blocks of eight adjacent scanning lines in an order within each block of second scanning line, first scanning line, fourth scanning line, third scanning line, sixth scanning line, fifth scanning line, eighth scanning line, and seventh scanning line.

7. The display screen of claim 6, wherein first capacitance value is a first capacitance ratio of a first mutual capacitance and a first self-capacitance, the second capacitance value is a second capacitance ratio of a second mutual capacitance and a second self-capacitance, and the second capacitance ratio is approximately twice the first capacitance ratio.

8. The display screen of claim 1, wherein the one of the first and second errors includes an average brightness error over a plurality of sub-pixels.

9. The display screen of claim 8, wherein the average brightness error over the plurality of sub-pixels includes an average brightness error over sub-pixels in a single display pixel.

10. The display screen of claim 1, the display screen incorporated within a computing system.

11. The display screen of claim 10, wherein the computing system includes one of a mobile telephone and a digital media player.

12. A method of scanning a display screen, the method comprising:

scanning a plurality of scanning lines of the display screen to update data voltages on pixel electrodes in sub-pixels of each scanning line in a scanning order of the scanning lines, the updating of the pixel electrodes in each scanning line including electrically connecting the pixel electrodes in each of a plurality of display pixels in the scanning line to a corresponding set of a plurality of data lines, applying a target data voltage to each data line in each of the sets of data lines in a predetermined sequence while the data lines corresponding to the other of the data lines in each set of the data lines are electrically floating, wherein a polarity of each of the target data voltages is determined by the scanning system according to a predetermined inversion scheme, wherein the inversion scheme includes a 4-dot inversion scheme, the scanning order includes a scanning order of updating scanning lines of a plurality of blocks of eight adjacent scanning lines in an order within each block of second scanning line, first scanning line, fourth scanning line, third scanning line, sixth scanning line, fifth scanning line, eighth scanning line, and seventh scanning line.

13. A non-transitory computer-readable storage medium storing computer-readable instructions that, when executed by a computing device, cause the device to perform a method of scanning a display screen, the method comprising:

scanning a plurality of scanning lines of the display screen to update data voltages on pixel electrodes in sub-pixels of each scanning line in a scanning order of the scanning lines, the updating of the pixel electrodes in each scanning line including electrically connecting the pixel electrodes in each of a plurality of display pixels in the scanning line to a corresponding set of a plurality of data lines, applying a target data voltage to each data line in each of the sets of data lines in a predetermined sequence while the data lines corresponding to the other of the data lines in each set of the data lines are electrically floating, wherein a polarity of each of the target data voltages is determined by the scanning system according to a predetermined inversion scheme, wherein the inversion scheme includes a 4-dot inversion scheme, the scanning order includes a scanning order of updating scanning lines of a plurality of blocks of eight adjacent scanning lines in an order within each block of second scanning line, first scanning line, fourth scanning line, third scanning line, sixth scanning line, fifth scanning line, eighth scanning line, and seventh scanning line.

* * * * *